US009470036B2

(12) United States Patent
Hodgson et al.

(10) Patent No.: US 9,470,036 B2
(45) Date of Patent: Oct. 18, 2016

(54) FENESTRATION INSTALLATION ASSEMBLY AND METHOD FOR USING THE SAME

(71) Applicant: Marvin Lumber and Cedar Company, Warroad, MN (US)

(72) Inventors: Peter Hodgson, Warroad, MN (US); Chris Ylitalo, Warroad, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

(21) Appl. No.: 14/921,671

(22) Filed: Oct. 23, 2015

(65) Prior Publication Data

US 2016/0115726 A1 Apr. 28, 2016

Related U.S. Application Data

(60) Provisional application No. 62/067,546, filed on Oct. 23, 2014.

(51) Int. Cl.
*E06B 1/04* (2006.01)
*E06B 1/02* (2006.01)

(52) U.S. Cl.
CPC .. *E06B 1/02* (2013.01); *E06B 1/04* (2013.01)

(58) Field of Classification Search
CPC ..... E06B 1/02; E06B 1/04; E06B 1/003; E06B 1/56; E06B 1/60; E06B 1/6069; E06B 1/6084; E06B 1/603
USPC ..... 52/213, 204.1
See application file for complete search history.

(56) References Cited

U.S. PATENT DOCUMENTS

| | | | | |
|---|---|---|---|---|
| 6,018,916 | A * | 2/2000 | Henry | E06B 1/6069 254/104 |
| 6,895,718 | B2 * | 5/2005 | Moffatt | E06B 1/6015 52/204.55 |
| 7,797,891 | B2 * | 9/2010 | Michaud | E06B 1/6069 49/504 |
| 2007/0199665 | A1 * | 8/2007 | Studney | A47H 99/00 160/99 |
| 2010/0083597 | A1 * | 4/2010 | Addison | E06B 3/306 52/204.53 |
| 2010/0269432 | A1 * | 10/2010 | Furgerson | E06B 1/02 52/213 |
| 2012/0144761 | A1 * | 6/2012 | Teodorovich | E06B 1/702 52/62 |
| 2013/0008106 | A1 * | 1/2013 | Michaud | E06B 1/68 52/213 |

* cited by examiner

*Primary Examiner* — Mark Wendell
(74) *Attorney, Agent, or Firm* — Schwegman Lundberg & Woessner, P.A.

(57) ABSTRACT

An installation assembly includes an installation member for use along a rough opening frame. The installation member includes a locking ridge. A fenestration interface is provided for use along a fenestration unit. The fenestration interface includes a fenestration anchor near the first end. The fenestration interface is movable within the rough opening frame from an unlocked configuration to a locked installed configuration. In the unlocked configuration the fenestration anchor slides over the locking ridge as the fenestration unit with the fenestration interface is seated within the rough opening frame. In the locked installed configuration the fenestration anchor slides off the locking ridge and the locking ridge is in an intercepting position relative to the fenestration anchor to fix the fenestration interface and the fenestration unit within the rough opening frame.

41 Claims, 10 Drawing Sheets

FENESTRATION INSTALLATION ASSEMBLY AND METHOD FOR USING THE SAME

CLAIM OF PRIORITY

The present application claims the priority of U.S. Provisional Patent Application Ser. No. 62/067,546, filed Oct. 23, 2014, which is hereby incorporated by reference.

TECHNICAL FIELD

This document pertains generally, but not by way of limitation, to fenestration assemblies and installation features for use with the same.

BACKGROUND

Fenestration units including windows and doors are installed within rough openings of buildings. Rough openings are formed with rough opening frames, and in some examples include lumber arranged to form the rough openings having variations in level, square or the like. Generally, rough openings have a corresponding size to the desired fenestration unit. The fenestration unit is positioned within the rough opening and shims are used to adjust the fenestration unit within the rough opening to achieve a square level installation.

After the initial installation (shimming), the fenestration units are optionally fixed in place, for instance by nailing fasteners through nailing flanges along the perimeter of the fenestration units. Flashing, such as a house wrap, is provided around the installed fenestration unit and in some examples extends over top of the nailing flanges. A decorative covering including stucco, siding or the like is applied over the house wrap and the nailing flange leaving the remainder of the window exposed.

Removal of the fenestration unit and replacement with a replacement fenestration unit requires, in at least some examples, removing the decorative covering around the installed fenestration unit and cutting or repositioning of the wrap to reveal the nailing flanges. The nailing flanges are decoupled from the wall, for instance by prying off the nails. The fenestration unit is then removed from the rough opening frame by pushing the unit through the opening against frictional engagement between the unit and the previously installed shims. The replacement fenestration unit is installed in the rough opening, squared and leveled (as provided above) and then fixed in place with the nailing flanges, and the house wrap and decorative covering are replaced and repaired to finish the installation.

OVERVIEW

The present inventors have recognized, among other things, that a problem to be solved can include decreasing time and labor for installation of fenestration units including windows and doors. A fenestration unit is installed when received at a job site and a rough opening is available to take the unit. The fenestration unit is placed in the rough opening and squared and leveled, for instance with a plurality of shims placed between the rough opening frame and the unit. The unit is repeatedly checked for square and level and the shims are correspondingly adjusted until a proper orientation of the unit is achieved. The fenestration unit is then tacked in place, for instance with a plurality of nails driven through nailing flanges around the unit.

In an example, the present subject matter can provide a solution to this problem by way of an installation assembly and method for installing the same. The installation assembly includes at least one installation member provided along an inner perimeter of a rough opening frame and a fenestration interface provided along an outer perimeter of a fenestration unit. The installation assembly includes features on each of the fenestration interface and the installation member to lock the fenestration unit in place when installed without requiring shimming of the fenestration unit or tacking of the unit in place. Instead, the installation member is coupled along the rough opening frame and adjusted (e.g., with a jack jamb screw or the like) to square and level the member within the rough opening. The installation member (as a single member or as an installation frame of one or more members) is easily manipulated by one or two technicians in comparison to a heavier and more cumbersome fenestration unit. When a square and level orientation is achieved, the installation member is fixed in place for instance by fastening a structural wall flange with a wall surface adjacent to the rough opening frame.

When the fenestration unit is available, whether at the time of installing the installation assembly or later when received on site, the fenestration unit (with the fenestration interface installed) is installed in the rough opening frame. For instance, the fenestration unit is installed from an interior-to-exterior direction or exterior-to-interior direction dependent on the orientation of the installed installation member. As the fenestration unit is installed a fenestration anchor of the fenestration interface moves over a locking ridge of the installation member. With continued movement the fenestration anchor slides over the locking ridge and assumes an intercepting position with the anchor aligned with the ridge to lock the fenestration unit in a locked installed configuration (e.g., the fenestration unit is snapped-in to position). The installation member when engaged with the fenestration interface of the unit automatically positions the fenestration unit within the rough opening (provided by the rough opening frame) in a corresponding orientation to the installation member. Accordingly, because the installation member is previously squared and leveled the fenestration unit in the locked installed configuration is also squared and leveled. Time consuming labor and repeated manipulation of the fenestration unit (e.g., with a level and shims) is accordingly avoided.

Additionally, and as described herein, the installation assembly provides one or more features, such as the wall flange and a nose flange, that facilitate the application of a sealant such as a silicone caulk gasket or the like. Further still, one or more of the installation member and the fenestration interface provide features such as a cladding flange (flange or plug) that facilitates the removable coupling of decorative trim including, but not limited to, cladding. The decorative trim is applied and is also removable to facilitate the future installation of differing decorative trim to an installation member, for instance as fenestration units are exchanged and installed to the installation member.

The present inventors have recognized, among other things, that another problem to be solved can include decreasing time and labor for installing replacement fenestration units and minimizing disturbance to the surrounding structure and facia of a building. In one example, the installation of a replacement fenestration requires extensive effort to decouple the unit from the rough frame opening and results in disturbance and damage to the surround features of a building including siding, stucco or the like.

In an example, the present subject matter including the installation assembly and the method for installing the same addresses the above described problem. Once installed, the installation member remains as a permanent fixture with the rough opening frame. The installer couples the installation member in a squared and level orientation and installs flashing, house wrap, decorative facia such as siding or stucco over top of the member. When replacement of a fenestration unit is desired a sealant is cut, for instance between a nose flange and a sealant flange of the respective installation member and fenestration interface and at least one of the locking ridge or the fenestration anchor is spaced (pried) away from the other to move the locking ridge from its intercepting position. The old fenestration unit is then pulled from the rough frame opening while the installation member remains. Sealant is reapplied to the installation member, for instance along a nose flange and in the corners of the installation members. A replacement fenestration unit having a fenestration interface compatible with the original installation member is then installed and the installation member including the locking ridge interfaces with the fenestration anchor of the fenestration interface to retain the replacement fenestration unit in the locked installed configuration. The installation member, previously squared and leveled, automatically squares and levels the replacement fenestration unit. Further, because the installation member remains as originally installed the rough opening frame and surrounding features such as, flashing, house wrap, decorative facia or the like are not disturbed while installing the replacement window. Additionally, new decorative trim, such as cladding, is readily installed along a feature of the installation member (e.g., a cladding flange) to match the replacement fenestration assembly or allow for changes in the decorative appearance of the building.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
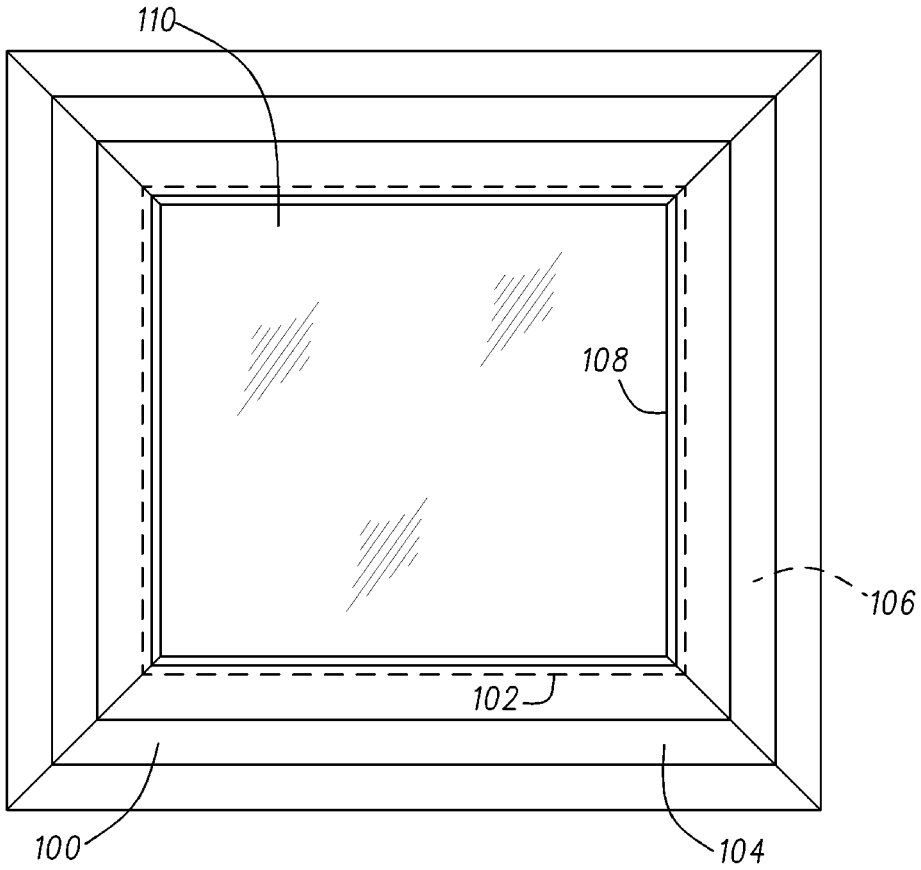
FIG. 1 is a front view of a fenestration unit within a rough opening.

FIG. 1 shows one example of a fenestration unit 100 (e.g., a window assembly or a door assembly) installed within a rough opening 102. The rough opening 102 includes one or more of a rough opening frame including an inner perimeter thereby forming an opening for reception of the fenestration unit 100 therein. As further shown in FIG. 1, the fenestration unit 100 includes a fenestration frame 108 including one or more of a header, jambs, sill and the like. The fenestration frame 108 is installed in the rough opening 102 and includes in the example shown a window pane 110. In another example, the window pane 110 is replaced with another panel, for instance a door panel or the like. Although the window pane 110 shown in FIG. 1 is shown as a single sheet of glass, in another example the window pane 110 includes a plurality of sashes slideably received within the fenestration frame 108 whether in a double-hung or lateral configuration. In another example, the fenestration frame 108 is sized and shaped to receive a door therein. For instance, the fenestration frame 108 includes hinges, latches and the like configured for reception and locking of a door within the fenestration frame 108.

Referring again to FIG. 1, the fenestration unit 100 is show in an interior view with one or more of cladding or decorative trim provided around the fenestration frame 108 and extending laterally relative to the rough opening 102 (shown in broken lines). As further shown in FIG. 1, the interior 104 of the rough opening 102 is shown with a solid lead line and the exterior 106 of the rough opening 102 is shown with a dashed lead line.

In at least some examples a fenestration unit such as the unit 100 shown in FIG. 1 is installed in some examples by way of roughly positioning the fenestration unit 100 in its entirety or near entirety within the rough opening 102 and subsequently using shims and the like to gradually level the fenestration unit 100 and thereafter adjust the position of the fenestration unit 100. For instance with interior and exterior movement, lateral movement, and elevation or tilting with shims to accordingly adjust (e.g., square, level, or align) the fenestration unit 100 with the rough opening 102.

As described herein, a new method and system for installation and adjustment of the fenestration unit 100 are provided, including an installation assembly 200 to facilitate the installation of a fenestration unit, such as the unit 100 shown in FIG. 1. As described herein and shown in FIGS. 2A, B, the installation assembly 200 includes one or more installation members 202 provided on an inner perimeter 226 of the rough opening 102 (e.g., rough opening frame 224) that facilitates cooperative engagement with another mating component including a fenestration interface provided on the fenestration unit 100. During installation the fenestration unit 100 is from the exterior 106 toward the interior 104 or from the interior 104 toward the exterior 106 to couple the fenestration interface with the installation member 202 and lock the fenestration unit 100 in an installed locked configuration. Additionally, in one example installation with the installation assembly also automatically adjusts the fenestration unit 100 including but not limited to one or more of leveling, aligning, squaring or the like as the fenestration unit 100 is installed into the rough opening 102.

Referring again to FIGS. 2A and 2B, one example of an installation member 202 for the installation assembly 200 is provided. In the example shown in FIGS. 2A, 2B, the installation member 202 extends between an exterior edge 204 and an interior edge 206. when installed corresponding approximately to the interior 104 and exterior 106 of the rough opening 102 shown in FIG. 1. As further shown in FIG. 2A, in one example the installation member 202 is a lineal piece, for instance extending into and out of the page and having one or more ends, such as the end 208 and a corresponding opposed end at the other end of the installation member 202. In at least some examples, the installation member 202 is formed by one or more moldings such as injection molding, extrusion, pultrusion or machining of a billet of material such as aluminum to form the installation member 202 and one or more of the features shown for instance in FIGS. 2A and 2B.

Figure 2A:
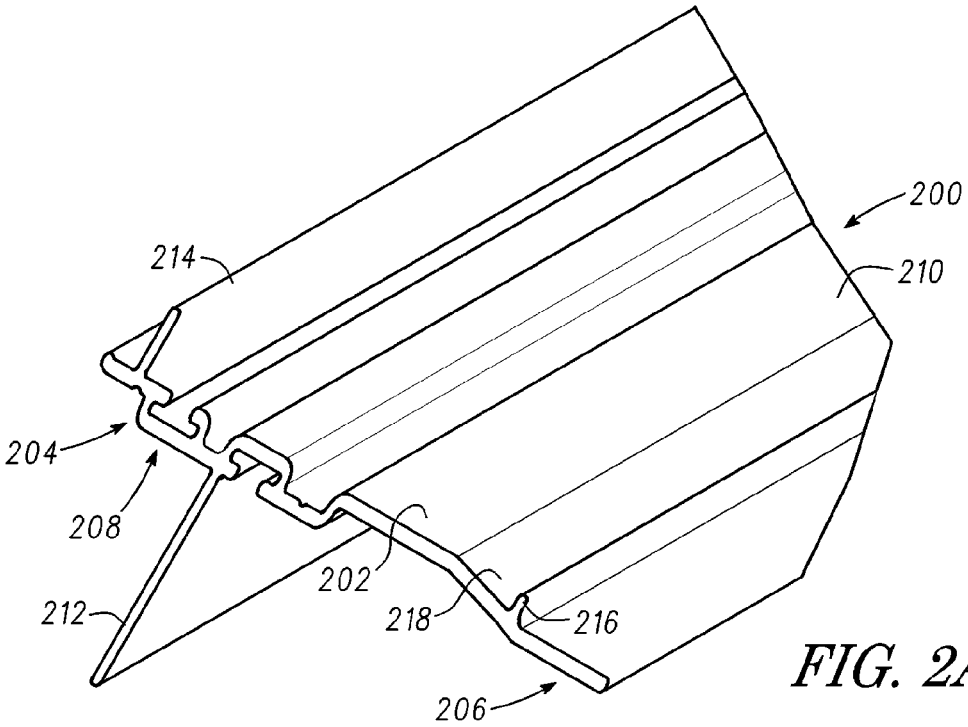
FIG. 2A is a perspective view of one example of an installation member of the installation assembly.
Figure 2B:
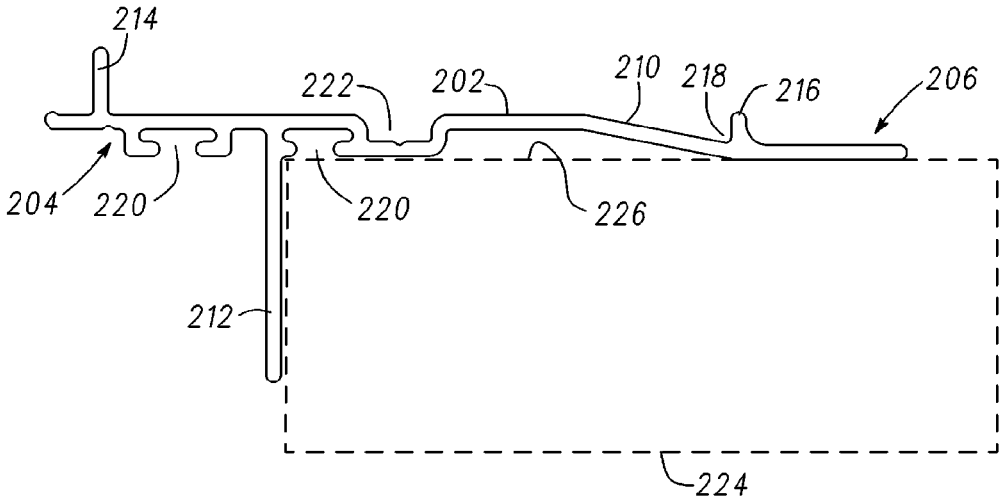
FIG. 2B is a side view of the installation member of FIG. 2A.

As shown in FIGS. 2A and 2B, the installation member 202 is shown with a fitting face 210. As will be described herein, the fitting face 210 is provided as a support surface to support a fenestration unit installed in the rough opening. That is to say, that the fitting face 210 provides at least one interface for coupling and support of the fenestration unit 100 during installation (e.g., the unlocked configuration) and after installation (e.g., the locked installed configuration) of the fenestration unit 100 into the rough opening 102. As will be described herein, in one example the fitting face 210 is a distributed feature extending along at least a portion of the installation member 202 between the exterior edge 204 and the interior edge 206. The fitting face 210 provides surface-to-surface contact with corresponding features of the fenestration unit 100 including but not limited to the fenestration interface (described herein). In another example, the fitting face 210 is located at one or more portions of the installation member 202 between the exterior edge 204 and the interior edge 206. For instance, the installation member 202 is provided with one or more components that provide a raised profile to provide engagement with a fenestration unit such as the unit 100 shown in FIG. 1 during installation and locking of the fenestration unit within the rough opening 102.

Referring now to FIG. 2B, the installation member 202 is further shown with one or more flanges, for instance flanges in close proximity to the exterior edge 204. In one example, the installation member 202 includes a wall flange 212 configured to extend along an exterior portion of the rough opening frame 224 show in FIG. 2B. The exterior of the rough opening frame 224 corresponds to the exterior 106 shown in FIG. 1. Optionally, the wall flange 212 is constructed with a material configured for penetration including but not limited to tin, aluminum, composites, polymers or the like. For instance, the wall flange 212 is in one example pierced by way of nails, screws, fasteners or the like to fasten the installation member 202 to the rough opening frame 224. In another example, the wall flange 212 is adhered to the rough opening frame 224 with an adhesive including glues, epoxy or the like. For instance during the installation of the installation member 202, an adhesive is applied along the inner face of the wall flange 212 (the face directed toward the rough opening frame 224) and the installation member 202 is positioned along the inner perimeter 226 of the rough opening frame 224 to thereby engage the wall flange 212 and the adhesive thereon with the rough opening frame 224. In another example, after positioning the wall flange 212 along the rough opening framer 224, fasteners including but not limited to, one or more of nails, screws, tacks or the like are driven through the wall flange 212 to fasten the installation member 202 to the rough opening frame 224.

In another example, one or more of shims or other adjustment means are provided between the installation member 202 (e.g., the fitting face 210 and the inner perimeter 226). Inter-positioning of shims or other adjustment devices between the installation member 202 and the inner perimeter of the rough opening frame 226 facilitates the leveling of the installation member 202 including the fitting face 210. Optionally, jamb jack screws are provided through one or more jamb jack receptacles on the installation member 222 to adjust the installation member, and then the wall flange 212 is fixed to the rough opening frame 224.

Because the installation members 202 weigh a fraction of the fenestration unit 100, the installation members 202 are readily installed, adjusted (leveled, squared or aligned) with the inner perimeter of the rough opening frame 226 by a single installer without having to laboriously move a fenestration unit 100 (in some instances weighing in excess of 100 pounds) relative to the rough opening frame 224. Accordingly, after adjustment of the installation member 202 (including but not limited to leveling, squaring or aligning), the wall flange 212 is fastened with the rough opening frame 224 for instance with one of more of the methods previously described herein including insertion of a fastener through the wall flange 212, gluing of the wall flange 212 to the rough opening frame 224 or a combination of the same.

In another example, the installation member 202 includes a nose flange 214. The nose flange 214 projects from an opposed face of the installation member 202, for instance from the fitting face 210 of the installation member 202 as shown in FIG. 2B. The nose flange 212, in once example, is configured to receive a leading edge (in this example an exterior directed portion) of the fenestration unit 100 during installation of the fenestration (e.g., in an interior 104 to exterior 106 installation). Additionally and as further described herein, the nose flange 214 also provides a surface configured to receive the sealant, for instance caulk, silicone, a gasket or the like thereon for coupling and sealing of the fenestration unit to the installation member 202. The seal provides an environmental seal on the fenestration unit 100 to prevent the ingress of elements, drafts, water or the like, through the fenestration unit 100 and the surrounding rough opening 102 (see FIG. 1).

As previously described the nose flange 214 also serves as a stop for the fenestration unit 100 during installation of the fenestration unit into the rough opening 102. The nose flange 214 catches and arrests further movement of the fenestration unit 100 during installation and cooperates with the locking ridge 216 (further described herein) to hold the fenestration unit in the locked installed configuration.

In another example and as further shown in FIG. 2B, the installation member 202 includes one or more other features configured to facilitate the adjustment of the installation member 202 and coupling of the installation member 202 with other installation members, for instance to form an installation frame. In a first example of the latter, the installation member 202 includes one or more corner key slots 220. As will be described herein, in one example one or more corner keys are provided with one or more corresponding installation members 202. The corner keys are fitted with the corner key slots 220 to form corners of an installation frame. Additional installation members 202 (cut to a desired length or provided at a specified length) are assembled with the corner keys to form an installation frame for positioning within the rough opening 102. A corresponding fenestration unit 100 is installed within the rough opening through coupling with the installation frame. The corresponding fenestration unit 100 includes one or more corresponding fenestration interfaces extending around the fenestration frame 108 (e.g., around the outer perimeter of the fenestration frame) that are configured for coupling with the installation members 202 provided in the installation frame. That is to say, the installation members 202 of such an installation frame cooperatively engage with corresponding fenestration interfaces to position and lock the fenestration unit when installed, for instance while moving from the interior 104 to the exterior 106.

In another example, the installation member 202 includes one or more adjustment features (described herein) including but not limited a jamb jack receptacle 222 as shown in FIG. 2B. In the example shown, the jamb jack receptacle 222 includes a recess in the installation member 202 sized and shaped to receive a jamb jack screw therein. In one example, the jamb jack screw is inserted through the jamb jack receptacle 222 (e.g., with a pilot hole). Rotation of the jamb jack screw relative to the jamb jack receptacle 222 allows for variable positioning of the installation member 202, including the fitting face 210, relative to the inner perimeter of the rough opening frame 226. In an example, where the installation member 20 is lineal and cut on site a plurality of jamb jack screws are optionally provided in the jamb jack receptacle 222 to accordingly position the installation member 202 in a variety of locations along the installation member length. Accordingly, precise adjustment of the installation member 202 including, but not limited to, leveling, squaring, alignment or the like of the installation member 202 is realized by adjusting each of the jamb jack screws within the jamb jack receptacle 222. In another example, after positioning of the jamb jack screws 222 at a desired position, for instance to accordingly adjustable position the fitting face 210, one or a plurality of shims are provided between the installation member 202, for instance along the interior edge 206 and the rough opening frame 224 to bias one or more features such as a locking ridge 216 into engagement with the fenestration unit 100 installed within the rough opening 102.

As previously described herein, the installation member 202 facilitates the installation of a fenestration unit 100 by locking the fenestration unit 100 in place during installation and in another example providing automatic adjustment of the fenestration unit 100 upon its installation. FIGS. 2A and 2B show examples of features configured to provide such an interface and engagement. For instance, the installation member 202 includes one or more locking features, such as a lock ridge 216, projecting away from the remainder of the installation member 202 (e.g., away from the fitting face 210). As will be described herein, the locking ridge 216 provides an interfering member sized and shaped to intercept the corresponding fenestration anchor of the fenestration interface to hold the fenestration interface and the associated fenestration unit 100 in a locked position after installation. As shown in FIGS. 2A and 2B, the locking ridge 216 is in one example provided proximate to the interior edge 206 and conversely remote relative to the exterior edge 204. An installation recess 218 is positioned in front of the locking ridge 216. In an example, the installation recess 218 provides an area for seating of the fenestration interface therein after installation of the fenestration interface and passage of the interface over top of the locking ridge 216. Reception of the fenestration interface within the installation recess 218 and corresponding interception of the locking ridge 216 by fenestration anchor seats and holds the fenestration unit in place between the locking ridge 216 and, in the example shown in FIGS. 2A and 2B, the nose flange 214. The locking ridge 216 is provide in one or more configurations including, but not limited to, an elongate ridge as shown in FIG. 2A, one or projections or the like.

As previously described herein, the installation member 202 further includes one or more fitting faces 201 sized and shaped to engage the corresponding portions of the fenestration unit 100 including, for instance, portions of the fenestration interface. In one example, as shown for instance in FIG. 2B, the fitting face 210 includes one or more surfaces including, for instance, a tapered surface as well as one or more planer surfaces extending between the interior edge 206 and the exterior edge 204. The fitting face 210 provides one or more locations sized and shaped to engage with corresponding locations of the fenestration unit 100 and thereby support (and in at least some examples, adjust) the fenestration unit 100 at installation. The previously described automatic adjustment of the fenestration unit includes, but is not limited to, one or more of alignment, leveling, squaring or the like of the fenestration unit 100 by way of the interface between the fitting face 210 and a corresponding fitting mount of the fenestration interface associated with the fenestration unit 100.

Figure 3:
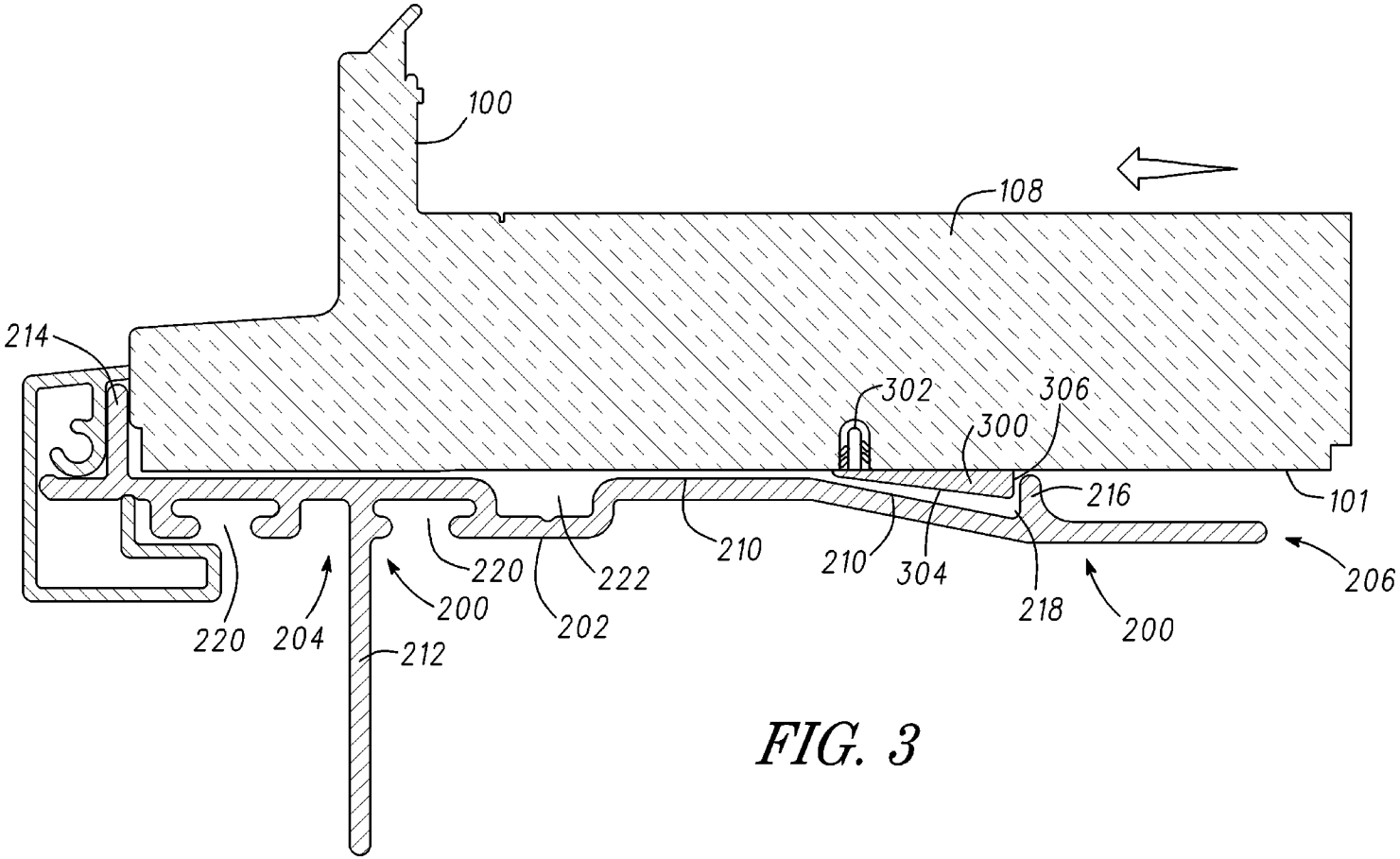
FIG. 3 is a cross sectional view of one example of a fenestration interface of the installation assembly coupled with the installation member of FIG. 2A.

FIG. 3 shows the installation assembly 200 in a locked installed configuration after having transitioned from the unlocked configuration (e.g., with movement from right to left as shown by the arrow). As previously described herein, the fenestration frame 108 of a fenestration unit 100 as shown in FIG. 1, is installed into the rough opening 102 in one or more of an interior to exterior sliding direction or in an exterior to interior sliding direction. In the example shown in FIG. 3, the fenestration frame 108 and the associated fenestration interface 300 are moved from an interior position (e.g., interior 104) toward an exterior position (e.g., exterior 106 in FIG. 1).

As shown in FIG. 3, the fenestration frame 108 in one example includes a fenestration interface 300 extending along the frame. In one example, the fenestration interface 300 is a lineal piece, for instance extending along the length or a portion of the length of the fenestration frame 108 (into and out of the page as shown in FIG. 3). In another example, the fenestration interface 300 includes one or more discrete elements provided at one or more corresponding locations along the fenestration frame 108 (e.g., along an outer perimeter of the frame 108). In another example, the fenestration interface 300 is provided along the fenestration frame 108 at locations corresponding to a plurality of installation members 202 provided along an inner perimeter 226 of the rough opening frame 225 as shown in FIG. 2B. As previously described herein, in such an example the installation members 202 are in one example formed into an installation frame provided around the rough opening 102 (see FIG. 1). The fenestration interfaces 300 are provided along corresponding portions of the fenestration frame 108 including, for instance, the header, jambs, sill or the like (e.g., the sides of the fenestration frame). Accordingly, with installation of the fenestration unit 100 the fenestration interfaces 300 are engaged by corresponding portions of the installation members 202 including, for instance, the locking ridges 216 to seat and lock the fenestration unit 100 in a locked installed configuration as shown in FIG. 3.

Referring again to FIG. 3, the fenestration interface 300 as shown includes a fenestration anchor 306 sized and shaped to engage with and intercept the locking ridge 216 as the fenestration frame 108 is seated within the rough opening (the rough opening 102 show in FIG. 1). For instance, as shown the fenestration interface 300 in one example includes a ramped or tapered configuration between first and second ends (e.g., an installation ramp) and the fenestration anchor 306 provided at one of the ends of the fenestration interface 300. During installation the fenestration interface 300 slides over the locking ridge 216 until the fenestration anchor 306 disengages from the locking ridge 216 and is received within the installation recess 218 shown in FIGS. 2B and 3.

As further shown in FIG. 3, in one example the fenestration interface 300 is provided as a separate component from the fenestration frame 108. For instance, the fenestration interface 300 includes one or more fasteners, such as barbs, screws, tacks or the like, sized and shaped to engage with corresponding features within the fenestration frame 108 including the fenestration frame material, recesses (for reception of barbs) or the like. Accordingly, a fenestration unit including a recess is sized and shaped to receive the fenestration interface 300 as an option, for instance installed in the field. In another example, the fenestration interface 300 is provided as an integral component with the fenestration frame 108. For instance, the fenestration interface 300 is formed with the fenestration frame 108, for instance during cutting of wood, molding of polymers, composites or the like. In another example, and as described herein, the fenestration interface 300 is a deflectable component coupled with the fenestration frame 108 including, but not limited to, a nailing flange for the fenestration unit.

As further shown in FIG. 3, in one example the fenestration interface 300 includes a fitting mount 304. The fitting mount 304 is, in one example, sized and shaped to interface with the fitting face 210. That is to say, in one example the fitting mount 304 provides one of one or more features of the fenestration frame 108 (including an integral or separate fenestration interface 300) sized and shaped for seating along and interfitting with the fitting face 210 of the installation member 202. As described herein, the engagement of the fitting mount 304 of one or more of the fenestration frame 108 (and the fenestration interface 300) and the corresponding fitting faces 210 of the installation member 202 supports the fenestration unit 100 in the locked installed configuration, and in one example automatically adjusts the fenestration unit 100 into a corresponding position and orientation to the installation member 202. That is to say, the fenestration unit is, in one example, automatically adjusted including one or more of aligned, squared, leveled or the like based on the previous adjustment of the installation member 202 prior to installation of the fenestration unit 100.

Referring again to FIG. 3, the installation assembly 200 is shown in a locked installed configuration with the fenestration unit 100 fully positioned and installed along the installation member 202. As previously described, in at least some examples the installation member 202 is previously adjusted and positioned within the rough opening 102, for instance, along the rough opening frame 224 and the inner perimeter 226 of the rough opening frame as shown in FIG. 2B. The wall flange 212 of the installation member 202 is coupled with the rough opening frame 224. With the installation member 202 installed (or installation members 202 installed, for instance along one or more sides of the rough opening frame 224) the fenestration unit 100, including a fenestration interface 300, is moved into position shown in FIG. 3. That is to say, the fenestration unit 100 is moved from an unlocked position, for instance where the fenestration unit is at least partially fit into the rough opening 102, and slid from the interior 104 shown in FIG. 1 toward the exterior 106. Movement of the fenestration unit 100 slides the fenestration frame 108 over the locking ridge 216 and optionally over one or more of the fitting faces 210, for instance the fitting faces 210 shown in FIG. 3. The fenestration unit continues to move forward until a portion of the fenestration unit, such as the fenestration frame 108, engages with one or more features of the installation member 202 including, for instance, the nose flange 214 shown in FIG. 3. Additionally, the fenestration interface 300 including, for instance, the fenestration anchor 306, slides over the locking ridge 216 and disengages from the locking ridge 216. As shown in FIG. 3, at disengagement the fenestration anchor 306 moves past the locked ridge 216 and moves into an intercepting position relative to the locking ridge 216. As shown in the example of FIG. 3, the fenestration anchor 306 is received within the installation recess 218. With the fenestration anchor 306 positioned past the locking ridge 216, the fenestration unit the fenestration frame 108, is positioned in the locked installed configuration as shown in FIG. 3. That is to say, the fenestration frame 108 is retained between the nose flange 214 and the locking ridge 216 with the fenestration anchor 306 in an intercepting orientation relative to the locking ridge 216. In this orientation, the fitting mount 304 of the fenestration interface 300 and the fitting face 210 of the installation member 202 engage with one another and accordingly positioning of the installation member 202 (including previous leveling, squaring, adjustment or the like of the installation member) is correspondingly assumed by the fenestration unit 100. That is to say the fenestration frame 108 including one or more fitting mounts 304 is biased into a corresponding orientation to the installation member 202 based on adjustments made to the installation member 202 during its installation within the rough opening 102.

Figure 4:
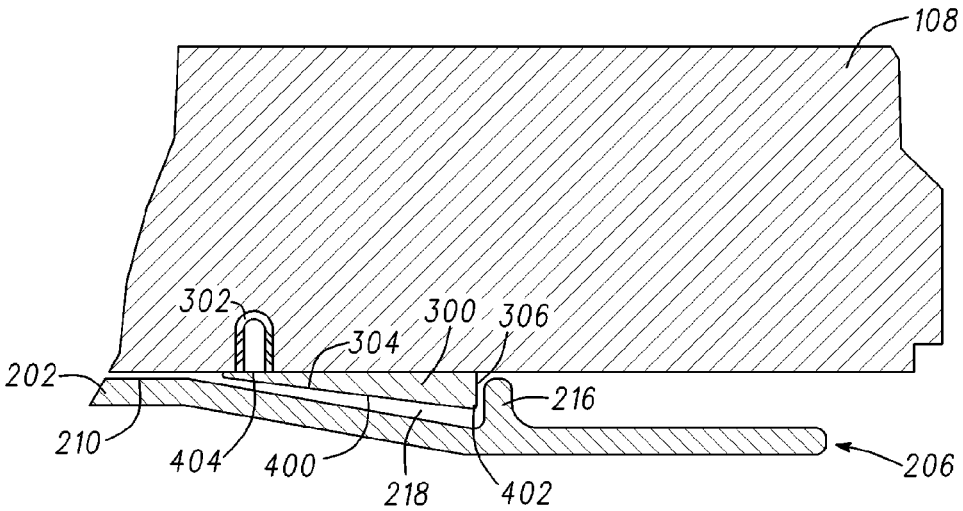
FIG. 4 is a detailed cross sectional view of a portion of the installation assembly.

FIG. 4 shows the interior edge 206 of the installation member 202 in detail with the fenestration frame 108 in the locked installed configuration including the fenestration interface 300 in an intercepting position with the locking ridge 216. As shown in FIG. 4, the fenestration interface in this example includes an installation ramp 400 extending from, for instance, a second end 404 toward a first end 402 having the fenestration anchor 306. As shown in this example, the installation ramp 400 is tapered from the first end 402 toward the second end 404 to facilitate movement of the fenestration frame 108 over both the installation member 202 and the inner perimeter 226 of the rough opening frame 224. As shown in FIG. 4, the installation ramp 400 readily slides over the locking ridge 216 until such time that the fenestration anchor 306 passes the locking ridge 216 and disengages from the locking ridge. As shown in FIG. 4, the fenestration anchor 306 is in an intercepting orientation relative to the locking ridge 216. Accordingly, the fenestration frame 108 of the fenestration unit 100 is locked in place once the fenestration unit 100 is fully relative to the installation member 202 and the rough opening 102. Optionally, the taper of the fenestration interface is provided at the locking ridge 216 to facilitate sliding movement between a tapered face of the locking ridge 216 and the fenestration anchor 306.

In another example, the fenestration interface in one example tapers from the first end 402 toward the second end 404 and is deflectable. In such an example the installation ramp 400 optionally includes a nailing flange configured for deflection relative to the installation member 202 during installation. The deformable nailing flange allows for the nailing flange to deflect while passing over top of the locking ridge 216 and thereafter deflect into an expanded orientation with the first end 402 of the nailing flange, such as the trailing edge of the nailing flange, received on the other side of the locking ridge 216 to position the nailing flange (the fenestration anchor 306) in an intercepting position relative to the locking ridge 216.

Figure 5:
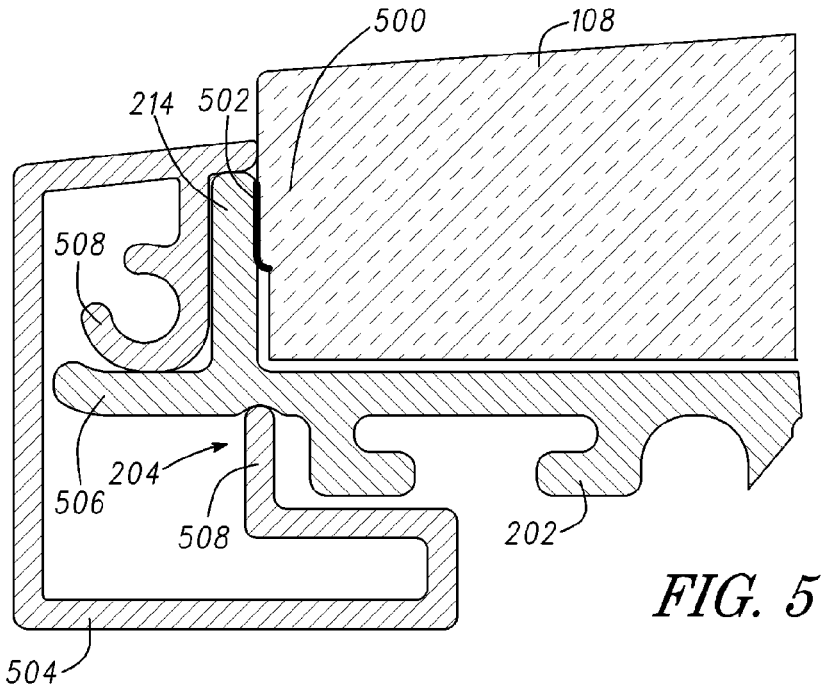
FIG. 5 is a detailed cross sectional view of another portion of the installation assembly coupled with cladding.

FIG. 5 shows a detailed view of the fenestration unit 100 in the installed locked configuration for instance with the fenestration frame 108 adjacent to a nose flange 214 of the installation member 202. As shown in FIG. 5, the fenestration frame 108 optionally includes a sealant flange 500 sized and shaped to engage the nose flange 214. In the example, a sealant 502 is provided between the nose flange 214 and the sealant flange 500. For instance, the sealant 502 is applied to the nose flange 214 prior to engagement with the fenestration unit sealant flange 500. In one example, the sealant 502 includes, but is not limited to, silicone, a gasket, weather stripping or the like. The engagement of the sealant flange with the nose flange 214 with the sealant 502 therebetween provides a sealed interface between the fenestration unit 100 and the installation member 202. The sealed interface between the nose flange 214 and the fenestration frame 108 (e.g., along the sealant flange 500) accordingly minimizes the ingress of water, drafts, particulate from the exterior environment and the like.

As will be described herein, where removal of a fenestration unit 100 is desired from the installation member 202 and the rough opening 102 (e.g., for installation of a replacement window) the sealant 502 is readily accessed, for instance, by way of a knife or planar tool inserted between the sealant flange 500 and the nose flange 215 to break the sealant 502 around the perimeter of the fenestration unit 100 and thereby allow backing out of the fenestration unit 100 from the rough opening 102. Referring now to FIG. 4, the locking ridge 216 of the installation member 202 is biased away from the fenestration anchor 306 and the fenestration frame 108. For instance one or more shims, tools or the like are inserted between the fenestration frame 106 and the installation member 202. The locking ridge 216 is thereby biased away from the fenestration anchor 306 to allow movement of the fenestration frame 108 toward the interior edge 206 of the installation member 202. The installation member 202 remains installed within the rough opening 102. The installer is then able to use the existing installation member 202 along with a fenestration interface 300 provided along the replacement fenestration unit 100 to install the replacement fenestration unit 100 in a substantially identical fashion. For instance, the replacement fenestration unit 100 including the fenestration frame 108 shown in FIGS. 4 and 5, is slid from the interior 104 toward an exterior 106 (FIG. 1) in the unlocked configuration. In this unlocked configuration the fenestration interface 300 slidably moves along the locking ridge 216. The fenestration anchor 306 passes over the locking ridge 216, disengages therefrom and assumes an intercepting configuration as shown in FIG. 4. In this orientation the fenestration frame 108 of the replacement fenestration unit 100 is in a locked installed configuration, for instance with the fenestration frame 108 retained between the locking ridge 216 (engaged with the fenestration anchor 306) and with the sealant flange 500 engaged with the nose flange 214.

As further shown in FIG. 5, decorative fascia such as cladding 504 is coupled to the installation member 202. As shown, the installation member 202 includes an optional flange such as a cladding flange 506 extending from the remainder of the installation member 202. The cladding flange 506 provides a feature configured for engagement with and retention of the cladding 504. One example of such an engagement is provided in FIG. 5. As shown, the cladding 504 includes one or more cladding jaws 508 provided on opposed sides of the cladding flange 506. The cladding 504 is configured so the cladding jaws 508 clamp the cladding flange 506 of the installation member 202 to thereby hold the cladding 504 in place. The homeowner, technician or the like may remove the cladding 504 readily from the cladding flange 506 and install cladding with an updated, appearance, different coloring, a different pattern or the onto the cladding flange 506.

FIGS. 6A-9 show another example of an installation assembly 600. In at least some regards the installation assembly 600 including, for instance, the installation member 602 and the fenestration interface 700 are similar to the corresponding components of the installation assembly 200 previously described herein. For instance, the installation member 602 shown in FIGS. 6A and 6B extends between an exterior edge 604 and an interior edge 606. In one example, the exterior edge and interior edges 604, 606 are positioned adjacent to the exterior 106 and interior 104 of the rough opening 102 shown in FIG. 1. In another example, the installation member 602 extends between the ends, for instance the end 608 shown in FIG. 6A and another opposed (e.g., extending into the page). In a lineal configuration the installation member 602 is cut to length or provided at specified lengths for use in the field. In another example, the installation member 602 comprises one or more separate installation members 602 sized and shaped for installation within the rough opening 102.

Figure 6A:
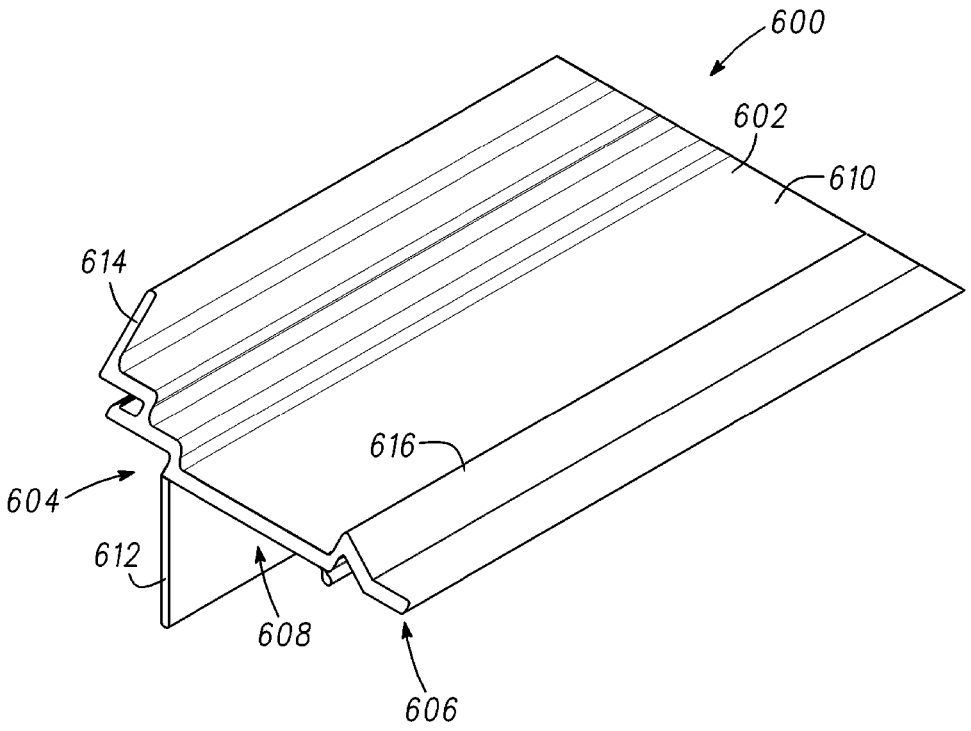
FIG. 6A is a perspective view of another example of an installation member of another installation assembly.
Figure 6B:
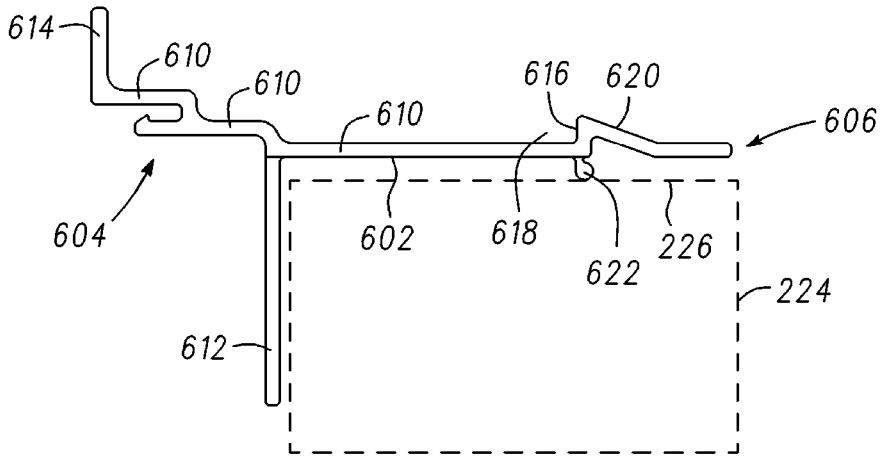
FIG. 6B is a side view of the installation member of FIG. 6A.

As shown in FIG. 6B, the installation member 602 includes one or more fitting faces 610 provided to support and position a fenestration unit, such as the fenestration unit 100 shown in FIG. 1. As described herein, the installation assembly 600 including the installation member 602 coupled with the fenestration member 700 is configured to position the fenestration unit 100 based on the positioning of the installation member 602 relative to the inner perimeter 226 of the rough opening frame 224 as shown in FIG. 6B. The fitting face 610 is configured to engage with the corresponding features of the fenestration unit including but not limited to the fenestration interface, such as the interface 700 shown in FIG. 7.

In another example, the installation member 602 includes one or more of a wall flange 612 and a nose flange 614. As previously described herein, the wall flange 612 is configured for coupling along the rough opening frame 224. In one example, the installation member 602 is installed within the rough opening 102 and thereafter adjusted including, but not limited to, leveling, squaring or aligning with the rough opening frame 224 or the like. After positioning of the installation member 602 in the desired orientation, the wall flange 612 is fastened to the rough opening frame 224. For instance, one or more fasteners, adhesive or the like are provided with the wall flange 612 to couple the wall flange 612 and the installation member 602 in the desired orientation with the rough opening frame 224. Accordingly, the installation member 602 is held static relative to the rough opening 102 and the orientation of the installation member 602 is assumed by the fenestration unit 100 when properly installed within the rough opening 102 using the fenestration interface.

In another example, the installation member 602 includes an optional feature such as the gap lobe 622 shown in FIG. 6B. The gap lobe 622 is provided to facilitate the installation of the installation member 602 in a rough opening to account for spacing between the fenestration unit relative to a relatively larger rough opening 102. The gap lobe 622 allows for positioning of the installation member 601 including for instance the fitting face 610 (or faces) in close proximity to the fenestration unit when installed in the rough opening 102. Where clearance between the fenestration unit 100 and the rough opening 102 (see FIG. 1) is minimal the gab lobe 622 is optionally removed for instance by breaking of the lobe 622 or a plurality of lobes from along the installation member 602. This accordingly provides additional clearance between the fenestration unit 100 and the rough opening 102 to allow installation of the installation member 602 and eventual reception of the fenestration unit having a fenestration interface within the rough opening 201.

Referring again to both FIGS. 6A and 6B, the installation member 602 includes (in a similar manner to the installation member 202) a locking ridge 616. In one example, the locking ridge 616 is a continuous feature extending along the length of the installation member 602 for instance in the manner shown in FIG. 6A. In another example, the locking ridge 616 is one or more projections (e.g., a plurality) or ridges extending along the installation member 602 in a discontinuous fashion. The locking ridge 616 provides an interfacing feature for use with the fenestration member 700, for instance with the fenestration anchor, to lock the installed fenestration unit 100 within the rough opening 102. As previously described herein, movement of the fenestration unit during installation between one or more of an exterior position toward an interior position or from the interior position toward an exterior position moves the fenestration member including a fenestration anchor over top of the locking ridge 616 and allows the fenestration anchor to pass the locking ridge 616 and position itself in an intercepting position with the locking ridge 616 to retain the fenestration unit in a locked installed configuration.

In the example shown in FIG. 6B, the locking ridge 616 includes a locking ridge ramp 620 tapering away from the locking ridge 616. As shown the locking ridge ramp 620 tapers toward the interior edge 606 of the installation member 602. The locking ridge ramp 620 facilitates the passage of the fenestration member including for instance the fenestration anchor over top of the locking ridge 616 during installation of the fenestration unit.

In another example, the installation member 602 shown in FIGS. 6A and 6B is provided in multiple components. For instance installation members 602 are configured (e.g., by specified lengths, cutting on site or the like) for installation along each of the sides of the rough opening 102, for instance along the inner perimeter 226 of the rough opening frame 224 (as shown in FIG. 6B). Optionally one or more corner keys are provided for the installation member 602 to facilitate the installation of the installation members 602 as an installation frame extending around the inner perimeter 226 of the rough opening 102 (e.g., continuously or near continuously). In another example, the installation members 602 are miter cut, for instance at a 45 degree angle, to facilitate the assembly of two or more installation members 602 at 90 degree angles relative to each other to fill the entirety or near entirety of the rough opening 102 with installation member 602 without corner key components.

Figure 7:
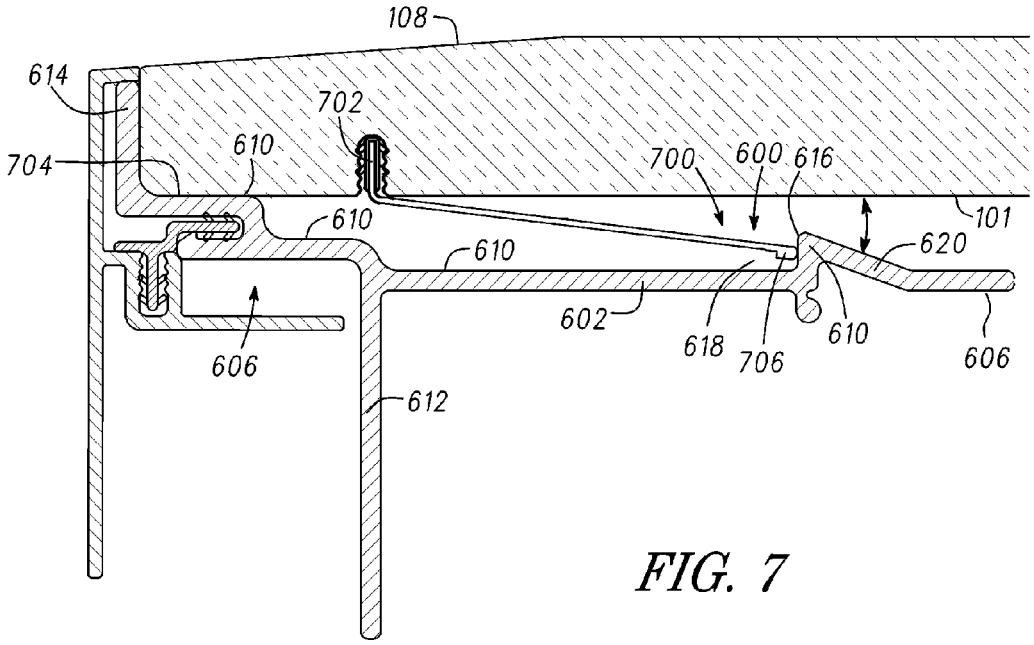
FIG. 7 is a cross sectional view of one example of a fenestration interface of the installation assembly coupled with the installation member of FIG. 6A.

FIG. 7 shows the installation assembly 700 in a locked installed configuration with the fenestration unit, for instance the fenestration frame 108, seated and engaged along the installation member 602. As shown, the fenestration frame 108 is engaged with a nose flange 614 of the installation member 602. Additionally, a fenestration interface 700 is provided with the fenestration frame 108. The fenestration anchor 706 of the fenestration interface 700 is provide in an intercepting configuration with the fenestration anchor 706 provided on the opposed side of the locking ridge 616 relative to the locking ridge ramp 620.

The fenestration interface 700 is shown in this example as a deflectable interface, for instance a deflectable nailing flange, extending from the fenestration frame 108. In one example, the deflectable nailing flange is bent with the fenestration anchor 706 directed toward the interior edge 606 of the installation member 602. As shown in FIG. 7, the fenestration interface 700 includes a deflectable component, such as a living hinge, provided at an end of the fenestration interface. As shown in FIG. 7, the fenestration interface 700 is initially biased into a folded configuration. As the fenestration frame 108 is installed, for instance from the interior edge 606 toward the exterior edge 604, the fenestration interface 700 slidably moves along the locking ridge 616 including in this example the locking ridge ramp 620.

The fenestration interface is in one example a separate component from the fenestration frame 108 that is coupled with the frame with a fastener 702. As shown in FIG. 7 in one example, the fastener 702 includes a barb received in a corresponding recess. In other examples, the fastener 702 includes, but is not limited to, a tacked flange, an interference fit flange, a flange secured by screws or nails or the like. In another example, the fenestration interface 700 is integral with the fenestration frame 108. For instance, the fenestration interface 700 is a deflectable feature such as a composite or polymer feature formed with the fenestration frame 108 and readily deformable by way of a living hinge relative to the remainder of the fenestration frame 108.

As further shown in FIG. 7, the fenestration frame 108 includes one or more fitting mounts 704 configured for corresponding engagement with a fitting face 610 of the installation member 602. As previously described herein, engagement of the fitting mounts 704 of the fenestration interface 700 with the corresponding fitting faces 610 of the installation member 602 allows for the ready positioning and automatic positioning of the fenestration unit including the fenestration frame 108 in a desired orientation within the rough opening 102. The installation member 602 is readily positioned in a desired orientation including, but not limited to, being leveled, squared, aligned or the like with the rough opening 102 without needing to manipulate a cumbersome fenestration unit. Accordingly, upon installation of the fenestration frame 108 with the installation assembly 600, the fenestration unit is readily (e.g., automatically) oriented according to the previous orientation of the installation member 602.

In operation, the fenestration unit including the fenestration interface 700 (whether integral or coupled with the fenestration frame 108) is positioned within the rough opening 102. For instance, the fenestration frame 108 is slid from an interior position toward an exterior position (corresponding generally to the exterior edge 606) in an unlocked configuration. As the fenestration frame 108 is slid into the rough opening 102, the fenestration interface 700, including for instance a deflectable nailing flange, slides over the locking ridge 616 and the optional locking ridge ramp 620. With movement of the fenestration frame 108 into the rough opening 102, the fenestration anchor 706 of the fenestration interface 700 disengages from the locking ridge 616 and is optionally received in the installation recess 618 shown in FIG. 6B and shown again in FIG. 7. Reception of the fenestration fenestration anchor 706 in the position show in FIG. 7 positions the fenestration unit in a locked installed configuration. As shown in FIG. 7, the fenestration frame 108 is engaged between a nose flange 614 and the locking ridge 616 by a leading edge of the fenestration frame 108 and the fenestration anchor 706, respectively. Accordingly, the fenestration unit (shown in FIG. 7 with a portion of the fenestration frame 108) is held in place and locked within the rough opening 102. Optionally, where the installation member 602 is previously adjusted within the rough opening 102, for instance by way of shimming, adjustment with a jamb jack screw or the like, the adjustment of the installation member 602 is assumed by the fenestration unit 100 according to the interface between the one or more fitting faces 610 of the installation member 602 and one or more fitting mounts 704 of one or more of the fenestration frame 108 and fenestration interface 700.

In another example, after installation and reception of the fenestration unit into the locked installed configuration shown in FIG. 7, a gap is provided between the locking ridge 616 and the fenestration frame 108. In an example, one or more shims or the like are provided between the installation member 602 and the inner perimeter 226 of the rough opening frame (see FIG. 8B) to bias the installation member 602 including the locking ridge 616 into engagement with the fenestration frame 108. In one example, biasing of the installation member 602 into engagement with the fenestration unit provides clamping engagement along the fenestration unit 100. With a plurality of installation members 602 at opposed sides of the rough opening opposed clamping is correspondingly provided along the top and bottom of the fenestration frame 108 or between each of the sides of the fenestration frame 108. The clamping engagement provided by the locking ridge 616 optionally holds the fenestration unit tightly within the rough opening 102 and further prevents the ingress of environmental particulate, moisture or the like.

In yet another example, the locking ridge 616 is relatively larger than the ridge shown in FIG. 7. For instance the locking ridge 612 (or fenestration frame 108 or fenestration interface 700) are relatively larger to bridge the gap between the installation member 602 and one or more of the fenestration frame 108 or the fenestration interface 700. That is to say, the locking ridge 616 includes a larger profile and thereby automatically engages with the fenestration frame 108 (or interface 700) upon installation of the fenestration frame 108 within the rough opening 102 (e.g., in a similar fashion to the installation assembly 200 shown for instance in FIGS. 2A, 2B, and 3).

Figure 8:
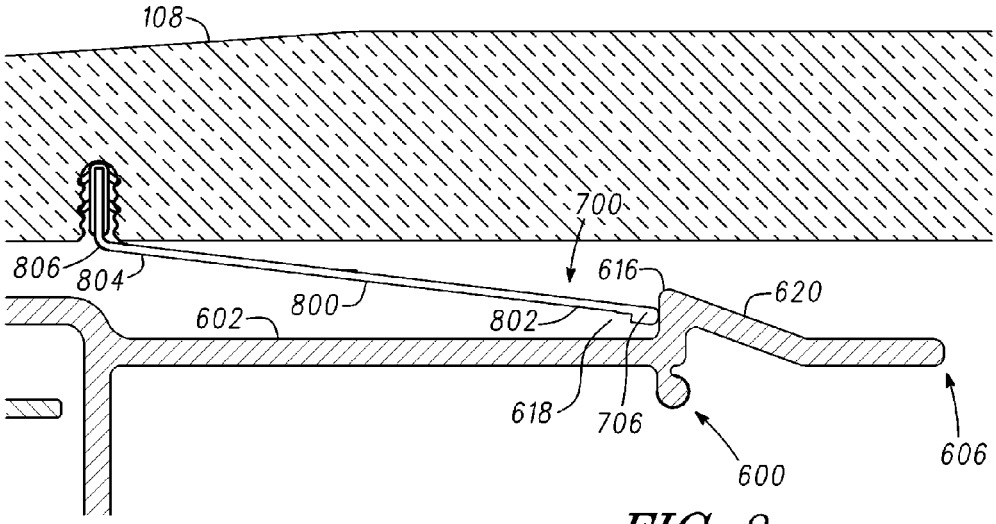
FIG. 8 is a detailed cross sectional view of a portion of the installation assembly.

FIG. 8 is a detailed view of a portion of the installation assembly 600 including, for instance, a portion of the fenestration unit 100 (the fenestration frame 108) in a locked installed configuration as previously shown in FIG. 7 and described herein. As shown in FIG. 8, an installation ramp 800 of the fenestration interface 700, in this example a deflectable nailing flange, is in the locked configuration with the fenestration anchor 706 (a trailing edge of the fenestration interface 700) positioned past the locking ridge 616 and in an intercepting position relative to the locking ridge. As shown in FIG. 8, the fenestration anchor 706 is provided proximate a first end 802 of the fenestration interface 700. As shown, the installation ramp 800 of the fenestration interface 700 tapers (is angled, sloped or the like) between the first end 802 and the second end 804 (e.g., adjacent to the shown fastener 702).

As previously described herein, in another example the fenestration interface 700 is integral to the fenestration frame 108. For instance, the fenestration interface 700 is co-molded with the fenestration frame 108 and uses a hinge, such as a living hinge, to deflect relative to the remainder of the fenestration frame 108. In the example shown in FIG. 8, the fenestration interface 700 is coupled with a fenestration frame 108 with the fastener 702. In the example shown, the fastener 702 includes one or more deflectable barbs received within a corresponding recess of the fenestration frame 108. As further shown in FIG. 8, the fenestration interface 700 includes a hinge 806 (e.g., a living hinge) configured to deflect the installation ramp 800 of the fenestration interface 700 into the orientation shown.

As the fenestration frame 108 is installed within the rough opening 102 (see FIG. 1) the fenestration frame 108 is moved laterally from the interior 104 toward the exterior 106 (shown in FIG. 1) and the fenestration interface 700 (e.g., the installation ramp 800) rides over the locking ridge 616 and the optional locking ridge ramp 620. Continued movement of the fenestration frame 108 disengages the installation ramp 800 and the fenestration anchor 706 provided at a first end 802 from the locking ridge 616. In one example, the elastic deflection of the fenestration interface 700 (e.g., at the hinge 806) allows the installation ramp 800 to deflect over the locking ridge 616 and deflect along the installation member 602 for instance into the position show in FIG. 8. That is to say, in one example the fenestration interface 700 deflects into the installation recess 618 provided at the opposed side of the locking ridge 616 relative to the locking ridge ramp 620. The position of the fenestration anchor 706 in the intercepting orientation shown in FIG. 8 along with reception of the fenestration frame 108 along the nose flange 614 of the installation member 602 accordingly holds the fenestration frame 108 therebetween in a similar manner to the installation assembly 200 previously described herein.

Figure 9:
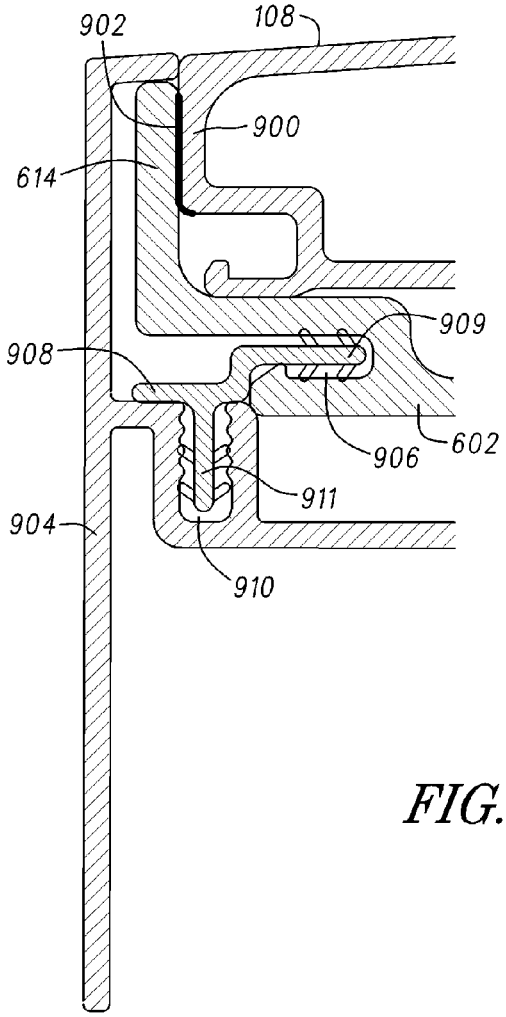
FIG. 9 is a detailed cross sectional view of another portion of the installation assembly coupled with cladding.

FIG. 9 shows another detailed view of a portion of the installation assembly 600 with the fenestration frame 108 and the fenestration unit in the locked installed configuration. As shown, the fenestration frame 108 includes a sealant flange 900 adjacent to the nose flange 614. In one example a sealant 902 including, but not limited to, one more of silicone, a gasket, weather stripping or the like is provided between the nose flange 614 and the sealant flange 900. For instance the sealant 902 is provided along the nose flange 614 prior to reception of the fenestration frame 108 in the locked installed configuration. As the fenestration frame 108 is moved into position and the sealant flange 900 is engaged with the nose flange 614, sealed engagement is provided there between with the sealant 902. The ingress of moisture, drafts, particulate matter from the exterior environment and the like are minimized between the installation member 602 and the fenestration frame 108.

As further shown in FIG. 9, cladding 904 or decorative facia is coupled with the installation assembly 600, for instance with another example of a coupling feature such as the plug recess 906. In the example shown a plug interface 908 including one or more fasteners is provided as an interface between the cladding 904 and the installation member 602. In the view shown in FIG. 9, the plug interface 908 includes a first plug 909 received within the plug recess 906 and a second plug 911 received within the cladding recess 910. When installation of the cladding 904 or other decorative fascia is desired, the cladding 904 with the plug interface 908 installed thereon is slid into engagement with the installation member 602, for instance with reception of the plug interface 908 including the first plug 909 within the plug recess 906. As shown in FIG. 9, the cladding 904 (in one example) extends vertically and conceals the installation member 602. Accordingly, a decorative appearance is provided for each of the installation members 902 as well as the front face of the fenestration frame 108 that conceals the components of the installation assembly 600 and provides a clean esthetically pleasing appearance for the fenestration unit 100 when installed. Further, the user (e.g., homeowner or the like) is readily able to remove the cladding 904 in exchange for updated or newer cladding, for instance having different colors, different properties (including ultraviolet protection), different profiles or the like. The user pulls the cladding 904, for instance the first plug 909 of the first interface 908 from the plug recess 906 and thereafter provides either a new plug interface 908 with the updated cladding or removes the plug interface 908 from the removed cladding (by pulling the second plug 911 from the cladding recess 910) and then installs it with the updated cladding to facilitate the installation of the replacement cladding 904 along the installation member 602.

Removal of the installed fenestration frame 108 from the rough opening 102 is readily accomplished without damaging either of the fenestration frame 108, fenestration unit 100 or the surrounding components of the installation assembly 600 such as the installation member 602 (or members 602) as well as the rough opening frame 224. In one example, a knife or other bladed tool is inserted between the nose flange 614 and sealant flange 900 (e.g., vertically) and is moved along the interface between the sealant flange and nose flange to break the sealant 902 and separate the sealant flange 900 from the nose flange 614 of the installation member 602. To disengage the fenestration anchor 706 from the locking ridge 616, in one example shims or the like are inserted between the installation member 602 and the fenestration interface 700. The locking ridge 616 is biased outwardly (down in FIG. 8) relative to the fenestration anchor 706 (e.g., by the application of force to the locking ridge ramp 620. The locking ridge 616 is thereby moved out of the intercepting position with the fenestration anchor 706. With the locking ridge 616 biased away from the fenestration anchor 706 the fenestration unit 100 is backed out toward the interior edge 606 of the installation member 602.

In another example, one or more slots are provided along the locking ridge that facilitate insertion of a tool (screw driver, shim or the like) between the fenestration anchor 706 and the surface of the installation member on the face of the locking ridge 616 opposed to the locking ridge ramp 620. The installation ramp 800 is biased (upwardly in FIG. 8) to thereby move the fenestration anchor 706 out of the intercepting position in the locked installed configuration. The fenestration unit 100 is then similarly backed out, as described herein.

The installation assembly 600 including for instance the installation member 602 is retained within the rough opening 102 and is thereafter ready for reception of a replacement window. A replacement window as shown in FIG. 8 would include substantially similar components at least in regards to the installation assembly 600 relative to the window shown in FIG. 8. For instance, the fenestration unit 100 would include one or more fenestration interfaces 700, for instance a deflectable nailing flange or the like moved into a position substantially similar to that shown in FIG. 8. With positioning of the replacement fenestration frame 108 within the rough opening 102 and lateral movement of the frame (e.g., interior to exterior) the installation ramp 800 of the fenestration interface 700 with the fenestration anchor 706 at the first end 802 slides over the locking ridge 616. The fenestration anchor 706 disengages from the locking ridge 616 and assumes an intercepting position with the locking ridge 616 to couple the replacement fenestration frame 108 in the locked installed configuration.

In the examples describing the installation assemblies 200, 600 the fenestration units 100 are installed from an interior to an exterior direction. In other examples, each of the components described herein are readily reversed to allow for installation of a fenestration unit 100 from the exterior toward the interior. For instance, one or more of the sealant flange and nose flange 214 are revered and proximate the interior edge 206 while the locking ridge 216 and the corresponding locking ridge 216 of the installation member 202 and the corresponding fenestration interface 300 and fenestration anchor 306 are proximate the exterior edge 204 (when installed). In such an example, the fenestration frame 108 of the fenestration unit 100 is readily delivered in an exterior to interior fashion to similarly engage the components of each of the fenestration interface 300 and the installation member 202 to transition the fenestration unit 100 from the unlocked sliding configuration to the locked installed configuration as previously described herein.

Figure 10:
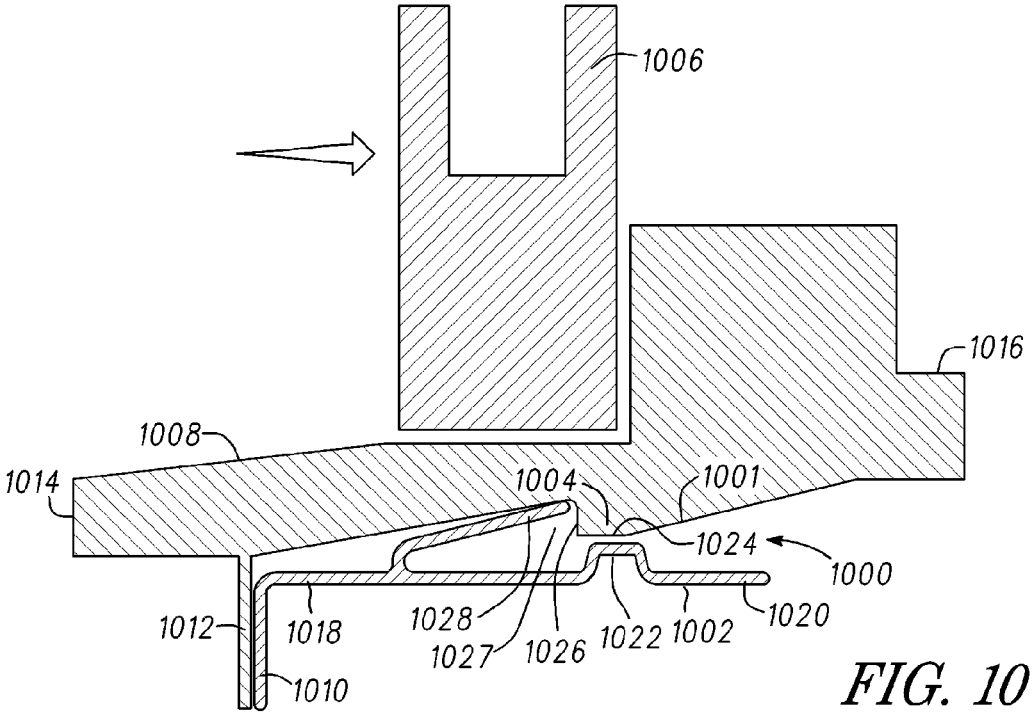
FIG. 10 is a cross sectional view of another example of an installation assembly with a fenestration interface installed from an exterior.

FIG. 10 shows another example of an installation assembly 1000 configured for use with a fenestration unit 1006 having a fenestration frame 1008. In this example, the fenestration unit 1000 is installed in an exterior to interior fashion. As shown, the installation assembly 1000 includes an installation member 1002 and a fenestration interface 1004. In the example shown in FIG. 10, the fenestration interface 1004 includes a fenestration anchor 1026 having a face directed toward the exterior 1014 of the fenestration unit (in contrast to the fenestration anchor shown in other embodiments herein directed toward the interior of the example fenestration units 100). Further in the example show in FIG. 2, the fenestration interface 1004 includes a tapered surface tapering away from the fenestration anchor 1026 (e.g., toward the interior 1016). As shown in FIG. 10, the fenestration anchor 1026 provides a vertical or near vertical surface for alignment (interception) with the locking ridge 1028. The tapered face of the fenestration interface 1004 allows the fenestration unit 1006 and the fenestration interface 1004 to readily slide over the locking ridge 1028.

Referring again to FIG. 10, the installation member 1002 is shown extending between an exterior edge 1018 and an interior edge 1020. As further shown, the installation member 1002 includes the locking ridge 1028. In the example shown in FIG. 10, the locking ridge 1028 is deflectable, for instance having a flange extending away from the remainder of the installation member 1003. The locking ridge 1028 is configured to deflect with movement of the fenestration unit 1006 (e.g., the fenestration frame 1008 and the fenestration interface 1004) over the locking ridge 1028. FIG. 10 shows the installation assembly 1000 in a locked installed configuration with the locking ridge 1028 disengaged from the fenestration anchor 1026 (for instance after movement to the fenestration frame 1008 in an exterior to an interior fashion). The fenestration anchor 1026 is disengaged from the locking ridge 1028 allowing the deflectable locking ridge 1028 to deflect upwardly, for instance toward the fenestration frame 1008 and assume an intercepting position with the fenestration anchor 1026.

As further shown in FIG. 10, a wall flange 1010 extends from the remainder of the installation member 1002. In one example, the wall flange 1010 is configured for engagement with the nailing flange 1012 of the fenestration frame 1008. As shown in FIG. 10 in the locked installed configuration the wall flange 1010 is engaged to the nailing flange 1012 and the locking ridge 1028 is deflected and in an intercepting position relative to the fenestration interface 1004 (the fenestration anchor 1026). The fenestration unit 1006 is thereby locked relative to the installation member 1002 and is statically positioned within a rough opening, for instance the rough opening 102 shown in FIG. 1.

As previously described herein, the installation members described in other embodiments provided herein are in examples adjusted prior to reception of the fenestration unit 100 within the rough opening 102. Similarly, the installation member 1002 shown in FIG. 10 is also adjusted including, but not limited to, one or more of leveling, squaring, aligning or the like relative to the rough opening 102, for instance along the rough opening frame 224 including for instance the inner perimeter 226 of the rough opening frame 224 (the frame and inner perimeter are shown in FIG. 2B). Adjustment to the installation member 1002 is readily done with one or more jamb jack screws, shims or the like interposed between the installation member 1002 and the inner perimeter 226. The installation member 1001 (as in previous examples) is relatively lightweight and easy to manipulate relative to an otherwise cumbersome fenestration unit such as the fenestration unit 1006. Accordingly, the installation member 1002 is installed in one or more locations of the rough opening 102 and thereafter adjusted to correspondingly position the fenestration unit 1006 in the desired orientation (e.g., leveled, squared, adjusted relative to the interior or exterior of the rough opening or the like).

As the fenestration unit 1006 is installed, the fitting mount 1024 or the fenestration interface 1004 engages with the fitting face 1022 to accordingly ensure the fenestration unit 1006 assumes a corresponding orientation to the installation member 1002. That is to say, with the fenestration unit 1006 in the locked installed configuration shown in FIG. 10, the adjustments provided to the installation member 1002 are carried over to the fenestration unit 1006 to accordingly ensure automatic and ready adjustment of the fenestration unit 1006 at installation including, but not limited to, squaring, leveling, alignment of the fenestration unit 1006 relative to the interior or exterior of the rough opening 102 or the like.

As previously described herein, the fenestration interface 1004 is in one example an integral component to the fenestration frame 1008. For instance as shown in FIG. 10, the fenestration interface 1004 includes a ridge and one or more tapered surfaces as well as a recess 1027 for reception of the locking ridge 1028 formed in the fenestration frame 1008 (e.g., by way of routing, cutting of the material of the frame, molding pultruding, extruding or the like). In another example, the fenestration interface 1004 is a separate component relative to the fenestration frame 1008 coupled along the outer perimeter of the fenestration frame 1008.

Figure 11:
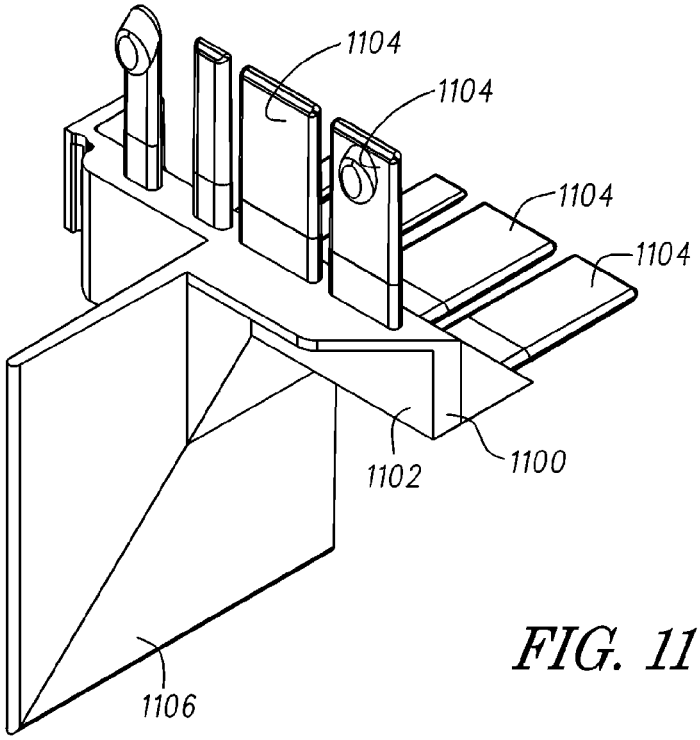
FIG. 11 is a perspective view of one example of a corner key.
Figure 12:
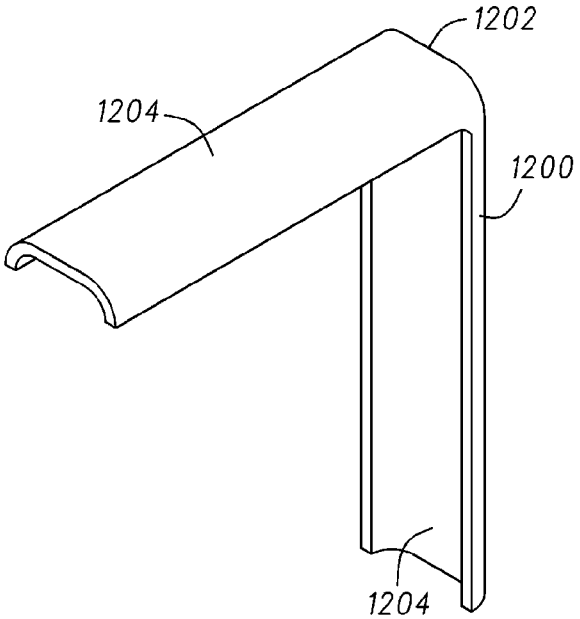
FIG. 12 is a perspective view of another example of a corner key.

FIGS. 11 and 12 show two examples of corner keys 1100, 1200 for use with one or more of the installation members described herein. Referring first to FIG. 11, the corner key 1100 is configured for use with the installation member 202 previously described and shown in FIG. 3. As shown, the corner key 1100 includes an elbow 1102 providing an interface between a plurality of installation members 202 installed along orthogonal sides of the rough opening 102. As previously described herein, a plurality of installation members 202 are in one example assembled as an installation frame for positioning within the rough opening 102. In one example, the corner key 1100 provides the interface between the installation members and couples the installation members together for fitting within the rough opening 102.

Referring again to FIG. 11, the corner key 1100 includes the elbow 1102 to provide an interface between two or more installation members 202. As shown, the elbow 1102 includes prongs 1104 sized and shaped for reception in corresponding corner key slots, such as the corner key slots 220 shown in FIG. 3. In one example, the prongs 1104 in combination with the corner key slots 220 provide an interference fit therebetween to robustly couple the corner keys 1100 and the installation members 202 together to form the installation frame.

As further shown in FIG. 11, the corner key 1100 includes a wall flange 1106. In one example, the wall flange 1106 provides a continuing interface along the rough opening 102 with the wall flange 212 of the installation member 202. Accordingly, the installation frame including each of the installation members 202 and the corner keys 1100 provides a continuous wall flange 1106 (and 212) for engagement with the exterior surface of the rough opening 102.

In one example, the corner key 1100 is formed by machining a billet of material such as aluminum or the like or injection molding of polymers.

In another example and as previously described here, the installation members 202 and the corner keys 1100 are formed into an installation frame, for instance an installation frame extending around the rough opening 102 shown in FIG. 1. That is to say in one example the installation members 202 are provided at a specified length corresponding to the rough opening side lengths and the corner keys 1100 provide an interface between each of the installation members 202 at the corners of the rough opening 102. In another example, the installation members 202 are provided as a lineal product and are cut to fit the rough opening 102 on site. After cutting of the installation members 202 the corner keys 1100 are fit to the installation members 202 and thereafter positioned in the rough opening 102 to provide the installation assembly 200 in a continuous or near continuous fashion around the rough opening 202.

Referring now to FIG. 12, another example of a corner key 1200 is provided. In this example the corner key 1200 includes an elbow 1202, and at least two prongs 1204 extending away from the elbow 1202, for instance at an angle corresponding to a corner of the rough opening 102. In the example shown in FIG. 12, the corner key 1200 is used with a miter cut installation member, for instance one or more of the installation members 202 or 602 (shown in FIG. 3 and FIG. 7). With the example installation member 602 shown in FIGS. 6A, B, in one example the installation member is provided as a lineal component and miter cut on site. The miter cut (in one example) corresponds to half of the total degree measure for a corner of the desired rough opening 102. For instance, with a corner of the rough opening measuring 90 degrees an end 608 of the installation member 602 is miter cut at 45 degrees. Another installation member 602 configured for coupling with the end 608 of the first installation member 602 is similarly cut with a 45 degree angle. The corner key 1200 is installed therebetween for instance into one or more corner key slots by way of insertion of the prongs 1204 into each of the corner key slots to provide an interface between each of the installation members 602. The miter cut ends 608 of the installation members 602 are thereby mated and coupled together by way of the corner key 1200 to form an installation frame for installation within the rough opening 102. The installation frame, including the one or more installation members 602 are thereby sized and shaped for continuous application around the rough opening 102 or in another example for near continuous application around the rough opening (e.g., along one more of the sides of the rough opening 102 including but not limited to the bottom, sides or top of the rough opening 102).

Figure 13:
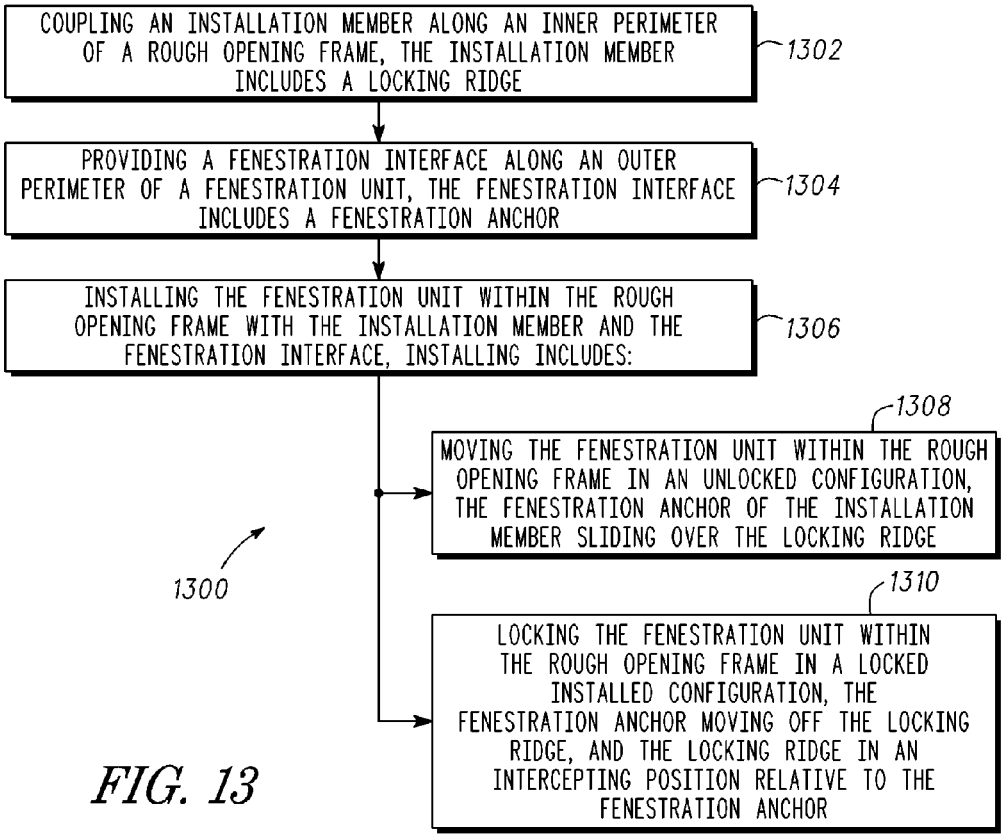
FIG. 13 is a block diagram showing one example of a method for installing a fenestration unit.

FIG. 13 shows one example of a method 1300 for installing a fenestration unit, such as the fenestration unit 100 shown in FIG. 1. In describing the method 1300, reference is made to one or more components, features, functions and steps previously described herein. Where convenient reference is made to the components, features, steps and the like with reference numerals. Reference numerals provided are exemplary and are not exclusive. For instance, components, features, functions, steps and the like described in the method 1300 include but are not limited to the other corresponding numbered elements provided herein, other corresponding features described herein (both numbered and unnumbered) as well as their equivalents.

At 1302, the method 1300 includes coupling an installation member, for instance one or more of the installation members 202, 602, 1002 along an inner perimeter 226 of the rough opening frame 224. The installation member includes a locking ridge. Examples of the locking ridge are provided herein including, for instance, the locking ridges 216, 616, 1028 shown respectively in FIGS. 2A, 2B, 6A, 6B and 10. As shown in the various examples the locking ridge in one example is a static feature provided on the installation member to intercept a fenestration anchor of a corresponding fenestration interface to hold the fenestration unit 100, 1006 in the locked installed configuration. In other examples, for instance as shown in FIG. 10, the locking ridge 1028 is a deflectable feature configured for movement into a position wherein the locking ridge 1028 intercepts the fenestration anchor 1026 of a corresponding fenestration interface such as the interface 1004.

At 1304, a fenestration interface, for instance one or more of the fenestration interfaces 300, 700, 1004, is provided along an outer perimeter (e.g., 101, 1001) of the respective fenestration units 100, 1006. In one example, the provision of the fenestration interface includes one or more of forming the fenestration interface integrally with the fenestration units and in another example forming the fenestration interface as a separate component coupled along the outer perimeter of the fenestration units. As described herein, the fenestration interfaces 300, 700, 1004 include one or more of installation ramps 400, 800 or fenestration anchors 306, 706, 1026 as shown in FIGS. 3, 8 and 10. In one example, the fenestration anchors are provided near an end, for instance a first end of the installation ramps 400, 800. As described herein, the fenestration interface, including the fenestration anchors, are configured to assume an intercepting position with the respective locking ridges to hold the installed fenestration unit in a locked installed configuration.

At 1306, the fenestration unit 100 (or 1006 as shown in FIG. 10) is installed within the rough opening frame, for instance the rough opening frame 224 shown in FIGS. 2B, 6B, with the installation assembly 200, 600, 1000 including for instance the respective installation members and fenestration interfaces described herein. At 1308, installing includes moving the fenestration unit (100, 1006) within the rough opening frame 224 in an unlocked configuration. For instance the fenestration unit 100, 1006 is slid or moved into the rough opening frame in a lateral fashion from the exterior 106 toward the interior 104 (FIG. 1) or from the interior 104 toward the exterior 106. Each of the installation assemblies 200, 600 described herein provide in one example for installation from the interior toward the exterior of the rough opening. The installation assembly 1000 shown in FIG. 10 provides an example assembly that is installed from the exterior toward the interior of the rough opening.

As further shown in the examples one or more of the installation ramps 400, 800 (as shown by the tapered feature of the locking ridge 1028) or the respective fenestration anchors 306, 706, 1028 slide or move over the corresponding locking ridges of the installation members. For instance, during installation these components are configured for slidable engagement along the locking ridge.

At 1310, installing the fenestration unit (100, 1006) includes locking the fenestration unit within the rough opening frame 224 in a locked installed configuration. In such an example, one or more of the installation ramp or fenestration anchor of each of the respective fenestration interfaces moves off the corresponding locking ridges 216, 616, 1028 and the locking ridge is positioned in an intercepting position relative to the respective fenestration anchors 306, 706, 1004. The intercepting positioning of the locking ridges relative to the respective fenestration anchors locks the fenestration unit in the locked installed configuration and prevents removal of the fenestration unit (without interaction by a technician, user or the like) from removal of the rough opening.

Several options for method 1300 follow. In one example, the method 1300 includes assembling a plurality of installation members, such as the installation members 202, 602, 1002, into an installation frame. For instance, as described herein the installation members are assembled with one or more corner keys 1100, 1200 coupled between the installation members. In another example, the installation members are formed in the frame confirmation, for instance by one or more of molding, adhering or the like to accordingly fit the specified size of the rough opening 102 shown in FIG. 1. In another example, the method 1300 including coupling of the installation member along the inner perimeter 226 of the rough opening includes coupling the installation frame around the inner perimeter of the rough opening frame (e.g., in a continuous or near continuous fashion). Similarly, in another example, the method 1300 includes providing a plurality of fenestration interfaces having a corresponding plurality of one or more installation ramps and fenestration anchors around an outer perimeter (101, 1001) of the respective fenestration units 100, 1006. For instance, in one example where an installation frame or the like is provided around the rough opening frame 224 corresponding fenestration interfaces 300, 700, 1004 are provided along respective surfaces of the fenestration frame 108, 1008. The method 1300 further includes locking the fenestration unit (100, 1006) by way of engaging the plurality of fenestration anchors of each of the fenestration interfaces with the plurality of locking ridges of the corresponding installation members around the inner perimeter 226 of the rough opening frame 224 and the outer perimeters 101, 1001 of the respective fenestration units 100, 1006. That is to say, coupling and locking of the fenestration unit is achieved along one or more surfaces of the rough opening by way of engagement of corresponding members of the installation assemblies described herein including each of the installation members and respective fenestration interfaces.

In another example, coupling the installation member or members along the inner perimeter 226 of the rough opening frame 224 includes adjusting the installation member with one or more of a jamb jack screw, shims or the like coupled between the installation members and the rough opening frame. As previously described herein, in one example shims are interposed between the installation member and the inner perimeter 226 of the rough opening frame 224 to accordingly position the installation member relative to the rough opening frame and adjust the installation member to cause corresponding automatic adjustment of the fenestration unit when installed within the rough opening. In another example, the jamb jack receptacle, for instance the receptacle 222 shown in FIG. 2B, receives one or more jamb jack screws for adjustments of the installation member 202 by way of adjustment of the one or more jamb jack screws provided along a length of installation member 202.

In another example, the method 1300 further includes fixing the installation member (e.g., the installation members 202, 602, 1002) at an adjusted position (for instance by way of one or more of a jamb jack screw, shims or the like) with a wall flange, such as the wall flanges 212, 612, 1010 of the installation members extending along a wall surface (e.g., the surface of the wall surrounding the rough opening 102). After adjustment of the installation members one or more of the fenestration units 100, 1006 are installed within the rough opening frame 224. In one example, installation of the fenestration unit 100, 1006 includes automatically adjusting (e.g., leveling, squaring, alignment relative to the rough opening or the like) of the fenestration unit 100, 1006 based on the adjustment of the respective installation members. That is to say the adjustment provided to the installation member 202, 602, 1002 prior to installation of the fenestration unit 100, 1006 causes automatic adjustment of the installed fenestration unit into desired orientation.

In another example, the method 1300 includes coupling cladding, for instance a decorative cladding or decorative fascia along the installation member (302, 602, 1002). In one example, coupling of cladding along the installation member includes coupling cladding along a nose flange of the installation member. In an example, the cladding conceals the nose flange and accordingly conceals the corresponding portion of the fenestration frame 108, 1008 including, for instance, a sealant flange or the like. Optionally the method 1300 further includes applying a sealant, such as the sealant 502, 902, along the respective nose flange 214, 614 of the respective installation members and moving the fenestration unit 100 within the rough opening 102 engages a sealant flange (500, 900) with the sealant provided on the nose flanges 214, 614.

In another example, moving the fenestration unit 1006 within the rough opening frame 224 includes one or more of the fenestration anchor or the installation ramp (for instance the tapered portion of the fenestration interface 1004) deflecting the locking ridge 1028 shown in FIG. 10. Locking the fenestration unit in the locked installed configuration includes one or more of the fenestration anchor 1026 or the installation ramp 1004 disengaging from the locking ridge 1028, and locking ridge deflecting into an intercepting position relative to the fenestration anchor 1026.

In still another example, the installation ramp (e.g., the fenestration anchor or the fenestration interface) includes a deflectable nailing flange (see FIGS. 7 and 8) and the end of the installation ramp includes a trailing edge of the deflectable nailing flange having the fenestration anchor 706. Moving the fenestration unit 100 within the rough opening frame 224 includes the locking ridge 616 deflecting the deflectable nailing flange (e.g., the installation ramp 800 or the fenestration anchor 706) of the fenestration interface 700. Locking the fenestration unit within the rough opening includes the deflectable nailing flange (e.g., the installation ramp 800 or anchor 706) moving off the locking ridge 616 and the deflectable nailing flange deflecting into the intercepting position (corresponding in one example to the installation recess 618) relative to the locking ridge 616.

VARIOUS NOTES & EXAMPLES

Example 1 can include subject matter such as can include an installation assembly for use with fenestration units and rough opening frames in buildings, the installation assembly comprising: an installation member along an inner perimeter of a rough opening frame, the installation member includes a locking ridge extending from the installation member; a fenestration interface along an outer perimeter of a fenestration unit, the fenestration interface includes an installation ramp tapering from a first end to a second end of the installation ramp and a fenestration anchor near the first end of the installation ramp; and wherein the fenestration interface is movable within the rough opening frame from an unlocked configuration to a locked installed configuration: in the unlocked configuration the installation ramp slides over the locking ridge as the fenestration unit with the fenestration interface is seated within the rough opening frame, and in the locked installed configuration the installation ramp slides off the locking ridge and the locking ridge is in an intercepting position relative to the fenestration anchor to fix the fenestration interface and the fenestration unit within the rough opening frame.

Example 2 can include, or can optionally be combined with the subject matter of Example 1, to optionally include wherein the locking ridge is a static projection extending away from the installation member.

Example 3 can include, or can optionally be combined with the subject matter of one or any combination of Examples 1 or 2 to optionally include wherein the locking ridge is a deflectable projection extending away from the installation member.

Example 4 can include, or can optionally be combined with the subject matter of one or any combination of Examples 1-3 to optionally include wherein the installation member includes a locking ridge ramp, and the locking ridge ramp tapers from the locking ridge.

Example 5 can include, or can optionally be combined with the subject matter of one or any combination of Examples 1-4 to optionally include wherein the installation member extends the length of one side of the inner perimeter of the rough opening frame.

Example 6 can include, or can optionally be combined with the subject matter of Examples 1-5 to optionally include a plurality of the installation members extending along sides of the inner perimeter of the rough opening frame, a plurality of the fenestration interfaces extending along sides of the outer perimeter of the fenestration unit.

Example 7 can include, or can optionally be combined with the subject matter of Examples 1-6 to optionally include wherein the plurality of installation members are coupled with each other with corner keys and form an installation frame corresponding to the sides of the inner perimeter of the rough opening frame.

Example 8 can include, or can optionally be combined with the subject matter of Examples 1-7 to optionally include wherein the fenestration interface includes a fitting mount engaged along a fitting face of the installation member in the locked installed configuration.

Example 9 can include, or can optionally be combined with the subject matter of Examples 1-8 to optionally include wherein the fitting mount includes the installation ramp.

Example 10 can include, or can optionally be combined with the subject matter of Examples 1-9 to optionally include wherein the installation ramp includes a deflectable nailing flange, the first end of the installation ramp includes a trailing edge of the deflectable nailing flange having the fenestration anchor.

Example 11 can include, or can optionally be combined with the subject matter of Examples 1-10 to optionally include wherein the installation member includes a jamb jack receptacle.

Example 12 can include, or can optionally be combined with the subject matter of Examples 1-11 to optionally include wherein the installation member includes a wall flange.

Example 13 can include, or can optionally be combined with the subject matter of Examples 1-12 to optionally include wherein the installation member includes a nose flange, the fenestration interface includes a sealant flange, and a sealant is interposed between the nose flange and the sealant flange in the locked installed configuration.

Example 14 can include, or can optionally be combined with the subject matter of Examples 1-13 to optionally include wherein the fenestration interface is coupled along a fenestration frame of the fenestration unit or is integral with the fenestration frame.

Example 15 can include, or can optionally be combined with the subject matter of Examples 1-14 to optionally include an installation assembly for use with fenestration units and rough opening frames in buildings, the installation assembly comprising: an installation member configured for installation between a fenestration unit and a rough opening frame, the installation member includes: a fitting face extending between exterior and interior edges of the installation member, and a locking ridge extending from the fitting face of the installation member; and a fenestration interface configured for coupling on a fenestration unit, the fenestration interface includes: a fitting mount extending along the fenestration interface, the fitting mount is engaged with the fitting face of the installation member in a locked installed configuration, an installation ramp tapering from a first end to a second end of the installation ramp, the installation ramp slides over the locking ridge during installation, and a fenestration anchor near the first end of the installation ramp, the locking ridge is in an intercepting position with the fenestration anchor in the locked installed configuration.

Example 16 can include, or can optionally be combined with the subject matter of Examples 1-15 to optionally include wherein the locking ridge is a static projection extending at least partially away from the fitting face.

Example 17 can include, or can optionally be combined with the subject matter of Examples 1-16 to optionally include wherein the locking ridge is a deflectable projection extending at least partially away from the fitting face.

Example 18 can include, or can optionally be combined with the subject matter of Examples 1-17 to optionally include wherein the installation member includes a locking ridge ramp, and the locking ridge ramp tapers from the locking ridge.

Example 19 can include, or can optionally be combined with the subject matter of Examples 1-18 to optionally include wherein the installation member extends the length of at least one side of an inner perimeter of a rough opening frame.

Example 20 can include, or can optionally be combined with the subject matter of Examples 1-19 to optionally include wherein the installation member includes corner key sockets at first and second ends of the installation member.

Example 21 can include, or can optionally be combined with the subject matter of Examples 1-20 to optionally include wherein the fitting mount includes the installation ramp.

Example 22 can include, or can optionally be combined with the subject matter of Examples 1-21 to optionally include wherein the installation ramp includes a deflectable nailing flange, the first end of the installation ramp includes a trailing edge of the deflectable nailing flange having the fenestration anchor.

Example 23 can include, or can optionally be combined with the subject matter of Examples 1-22 to optionally include wherein the installation member includes a jamb jack receptacle.

Example 24 can include, or can optionally be combined with the subject matter of Examples 1-23 to optionally include wherein the installation member includes a wall flange.

Example 25 can include, or can optionally be combined with the subject matter of Examples 1-24 to optionally include wherein the installation member includes a nose flange, the fenestration interface includes a sealant flange, and a sealant is interposed between the nose flange and the sealant flange in the locked installed configuration.

Example 26 can include, or can optionally be combined with the subject matter of Examples 1-25 to optionally include cladding coupled along a cladding flange of the installation member.

Example 27 can include, or can optionally be combined with the subject matter of Examples 1-26 to optionally include wherein the fenestration interface is configured for coupling along a fenestration frame or is integral with the fenestration frame.

Example 28 can include, or can optionally be combined with the subject matter of Examples 1-27 to optionally include a fenestration unit and a rough opening frame.

Example 29 can include, or can optionally be combined with the subject matter of Examples 1-28 to optionally include a method of installing a fenestration unit comprising: coupling an installation member along an inner perimeter of a rough opening frame, the installation member includes a locking ridge; providing a fenestration interface along an outer perimeter of a fenestration unit, the fenestration interface includes an installation ramp and a fenestration anchor near an end of the installation ramp; and installing the fenestration unit within the rough opening frame with the installation member and the fenestration interface, installing includes: moving the fenestration unit within the rough opening frame in an unlocked configuration, the installation ramp of the installation member sliding over the locking ridge, and locking the fenestration unit within the rough opening frame in a locked installed configuration, the installation ramp moving off the locking ridge, and the locking ridge in an intercepting position relative to the fenestration anchor.

Example 30 can include, or can optionally be combined with the subject matter of Examples 1-29 to optionally include wherein installing the fenestration unit within the rough frame opening includes moving the fenestration unit in the unlocked configuration from an interior toward an exterior of the rough frame opening to lock the fenestration unit in the locked installed configuration.

Example 31 can include, or can optionally be combined with the subject matter of Examples 1-30 to optionally include wherein installing the fenestration unit within the rough frame opening includes moving the fenestration unit in the unlocked configuration from an exterior toward an interior of the rough frame opening to lock the fenestration unit in the locked installed configuration.

Example 32 can include, or can optionally be combined with the subject matter of Examples 1-31 to optionally include assembling a plurality of installation members having a plurality of locking ridges into an installation frame, and coupling the installation member along the inner perimeter includes coupling the installation frame around the inner perimeter of the rough opening frame.

Example 33 can include, or can optionally be combined with the subject matter of Examples 1-32 to optionally include wherein providing the fenestration interface includes providing a plurality of fenestration interfaces having a corresponding plurality of installation ramps and fenestration anchors around an outer perimeter of the fenestration unit.

Example 34 can include, or can optionally be combined with the subject matter of Examples 1-33 to optionally include wherein locking the fenestration unit includes engaging the plurality of fenestration anchors with the plurality of locking ridges around both the inner perimeter of the rough opening and the outer perimeter of the fenestration unit.

Example 35 can include, or can optionally be combined with the subject matter of Examples 1-34 to optionally include wherein coupling the installation member along the inner perimeter of the rough opening frame includes: adjusting the installation member with a jamb jack screw coupled between the installation member and the rough opening frame, and fixing the installation member at an adjusted position with a wall flange of the installation member extending along a wall surface.

Example 36 can include, or can optionally be combined with the subject matter of Examples 1-35 to optionally include wherein adjusting the installation member includes leveling the installation member, and installing the fenestration unit within the rough opening frame includes automatically leveling the fenestration unit based on the leveling of the installation member.

Example 37 can include, or can optionally be combined with the subject matter of Examples 1-36 to optionally include coupling cladding along the installation member.

Example 38 can include, or can optionally be combined with the subject matter of Examples 1-37 to optionally include wherein coupling cladding along the installation member includes coupling cladding along a nose flange of the installation member.

Example 39 can include, or can optionally be combined with the subject matter of Examples 1-38 to optionally include wherein installing the fenestration until within the rough opening frame includes: applying a sealant along a nose flange of the installation member, and moving the fenestration unit within the rough opening engages a sealant flange of the fenestration interface with the sealant.

Example 40 can include, or can optionally be combined with the subject matter of Examples 1-39 to optionally include wherein moving the fenestration unit within the rough opening frame includes the installation ramp deflecting the locking ridge, and locking the fenestration unit includes the installation ramp moving off the locking ridge and the locking ridge deflecting into the intercepting position relative to the fenestration anchor.

Example 41 can include, or can optionally be combined with the subject matter of Examples 1-40 to optionally include wherein the installation ramp includes a deflectable nailing flange and the end of the installation ramp includes a trailing edge of the deflectable nailing flange having the fenestration anchor, and moving the fenestration unit within the rough opening frame includes the locking ridge deflecting the deflectable nailing flange, and locking the fenestration unit includes the deflectable nailing flange moving off the locking ridge and the deflectable nailing flange deflecting into the intercepting position relative to the locking ridge.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. An installation assembly for use with fenestration units and rough opening frames in buildings, the installation assembly comprising:

an installation member along an inner perimeter of a rough opening frame, the installation member includes a locking ridge extending from the installation member;

a fenestration interface along an outer perimeter of a fenestration unit, the fenestration interface includes an installation ramp tapering from a first end to a second end of the installation ramp and a fenestration anchor near the first end of the installation ramp; and wherein the fenestration interface is movable within the rough opening frame from an unlocked configuration to a locked installed configuration:

in the unlocked configuration the installation ramp slides over the locking ridge as the fenestration unit with the fenestration interface is seated within the rough opening frame, and in the locked installed configuration the installation ramp slides off the locking ridge and the locking ridge is in an intercepting position relative to the fenestration anchor to fix the fenestration interface and the fenestration unit within the rough opening frame.

2. The installation assembly of claim 1, wherein the locking ridge is a static projection extending away from the installation member.

3. The installation assembly of claim 1, wherein the locking ridge is a deflectable projection extending away from the installation member.

4. The installation assembly of claim 1, wherein the installation member includes a locking ridge ramp, and the locking ridge ramp tapers from the locking ridge.

5. The installation assembly of claim 1, wherein the installation member extends the length of one side of the inner perimeter of the rough opening frame.

6. The installation assembly of claim 1, comprising:

a plurality of the installation members extending along sides of the inner perimeter of the rough opening frame, a plurality of the fenestration interfaces extending along sides of the outer perimeter of the fenestration unit.

7. The installation assembly of claim 6, wherein the plurality of installation members are coupled with each other with corner keys and form an installation frame corresponding to the sides of the inner perimeter of the rough opening frame.

8. The installation assembly of claim 1, wherein the fenestration interface includes a fitting mount engaged along a fitting face of the installation member in the locked installed configuration.

9. The installation assembly of claim 8, wherein the fitting mount includes the installation ramp.

10. The installation assembly of claim 1, wherein the installation ramp includes a deflectable nailing flange, the first end of the installation ramp includes a trailing edge of the deflectable nailing flange having the fenestration anchor.

11. The installation assembly of claim 1, wherein the installation member includes a jamb jack receptacle.

12. The installation assembly of claim 1, wherein the installation member includes a wall flange.

13. The installation assembly of claim 1, wherein the installation member includes a nose flange, the fenestration interface includes a sealant flange, and a sealant is interposed between the nose flange and the sealant flange in the locked installed configuration.

14. The installation assembly of claim 13, wherein the fenestration interface is coupled along a fenestration frame of the fenestration unit or is integral with the fenestration frame.

15. An installation assembly for use with fenestration units and rough opening frames in buildings, the installation assembly comprising:

an installation member configured for installation between a fenestration unit and a rough opening frame, the installation member includes:

a fitting face extending between exterior and interior edges of the installation member, and a locking ridge extending from the fitting face of the installation member; and a fenestration interface configured for coupling on a fenestration unit, the fenestration interface includes:

a fitting mount extending along the fenestration interface, the fitting mount is engaged with the fitting face of the installation member in a locked installed configuration, an installation ramp tapering from a first end to a second end of the installation ramp, the installation ramp slides over the locking ridge during installation, and a fenestration anchor near the first end of the installation ramp, the locking ridge is in an intercepting position with the fenestration anchor in the locked installed configuration.

16. The installation assembly of claim 15, wherein the locking ridge is a static projection extending at least partially away from the fitting face.

17. The installation assembly of claim 15, wherein the locking ridge is a deflectable projection extending at least partially away from the fitting face.

18. The installation assembly of claim 15, wherein the installation member includes a locking ridge ramp, and the locking ridge ramp tapers from the locking ridge.

19. The installation assembly of claim 15, wherein the installation member extends the length of at least one side of an inner perimeter of a rough opening frame.

20. The installation assembly of claim 15, wherein the installation member includes corner key sockets at first and second ends of the installation member.

21. The installation assembly of claim 15, wherein the fitting mount includes the installation ramp.

22. The installation assembly of claim 15, wherein the installation ramp includes a deflectable nailing flange, the first end of the installation ramp includes a trailing edge of the deflectable nailing flange having the fenestration anchor.

23. The installation assembly of claim 15, wherein the installation member includes a jamb jack receptacle.

24. The installation assembly of claim 15, wherein the installation member includes a wall flange.

25. The installation assembly of claim 15, wherein the installation member includes a nose flange, the fenestration interface includes a sealant flange, and a sealant is interposed between the nose flange and the sealant flange in the locked installed configuration.

26. The installation assembly of claim 15 comprising cladding coupled along a cladding flange of the installation member.

27. The installation assembly of claim 15, wherein the fenestration interface is configured for coupling along a fenestration frame or is integral with the fenestration frame.

28. The installation assembly of claim 15 comprising a fenestration unit and a rough opening frame.

29. A method of installing a fenestration unit comprising:

coupling an installation member along an inner perimeter of a rough opening frame, the installation member includes a locking ridge;

providing a fenestration interface along an outer perimeter of a fenestration unit, the fenestration interface includes an installation ramp and a fenestration anchor near an end of the installation ramp; and installing the fenestration unit within the rough opening frame with the installation member and the fenestration interface, installing includes:

moving the fenestration unit within the rough opening frame in an unlocked configuration, the installation ramp of the installation member sliding over the locking ridge, and locking the fenestration unit within the rough opening frame in a locked installed configuration, the installation ramp moving off the locking ridge, and the locking ridge in an intercepting position relative to the fenestration anchor.

30. The method of claim 29, wherein installing the fenestration unit within the rough frame opening includes moving the fenestration unit in the unlocked configuration from an interior toward an exterior of the rough frame opening to lock the fenestration unit in the locked installed configuration.

31. The method of claim 29, wherein installing the fenestration unit within the rough frame opening includes moving the fenestration unit in the unlocked configuration from an exterior toward an interior of the rough frame opening to lock the fenestration unit in the locked installed configuration.

32. The method of claim 29, comprising assembling a plurality of installation members having a plurality of locking ridges into an installation frame, and coupling the installation member along the inner perimeter includes coupling the installation frame around the inner perimeter of the rough opening frame.

33. The method of claim 32, wherein providing the fenestration interface includes providing a plurality of fenestration interfaces having a corresponding plurality of installation ramps and fenestration anchors around an outer perimeter of the fenestration unit.

34. The method of claim 33, wherein locking the fenestration unit includes engaging the plurality of fenestration anchors with the plurality of locking ridges around both the inner perimeter of the rough opening and the outer perimeter of the fenestration unit.

35. The method of claim 29, wherein coupling the installation member along the inner perimeter of the rough opening frame includes:

adjusting the installation member with a jamb jack screw coupled between the installation member and the rough opening frame, and fixing the installation member at an adjusted position with a wall flange of the installation member extending along a wall surface.

36. The method of claim 35, wherein adjusting the installation member includes leveling the installation member, and installing the fenestration unit within the rough opening frame includes automatically leveling the fenestration unit based on the leveling of the installation member.

37. The method of claim 29 comprising coupling cladding along the installation member.

38. The method of claim 37, wherein coupling cladding along the installation member includes coupling cladding along a nose flange of the installation member.

39. The method of claim 29, wherein installing the fenestration until within the rough opening frame includes:

applying a sealant along a nose flange of the installation member, and moving the fenestration unit within the rough opening engages a sealant flange of the fenestration interface with the sealant.

40. The method of claim 29, wherein moving the fenestration unit within the rough opening frame includes the installation ramp deflecting the locking ridge, and locking the fenestration unit includes the installation ramp moving off the locking ridge and the locking ridge deflecting into the intercepting position relative to the fenestration anchor.

41. The method of claim 29, wherein the installation ramp includes a deflectable nailing flange and the end of the installation ramp includes a trailing edge of the deflectable nailing flange having the fenestration anchor, and moving the fenestration unit within the rough opening frame includes the locking ridge deflecting the deflectable nailing flange, and locking the fenestration unit includes the deflectable nailing flange moving off the locking ridge and the deflectable nailing flange deflecting into the intercepting position relative to the locking ridge.

* * * * *